US008756886B1

(12) United States Patent
Grant

(10) Patent No.: US 8,756,886 B1
(45) Date of Patent: Jun. 24, 2014

(54) ADJUSTABLE RADIUS BULLNOSE CORNER

(76) Inventor: Tim W. Grant, Willis, TX (US)

( * ) Notice: Subject to any disclaimer, the term of this patent is extended or adjusted under 35 U.S.C. 154(b) by 0 days.

(21) Appl. No.: 12/502,962

(22) Filed: Jul. 14, 2009

(51) Int. Cl.
*E04B 2/00* (2006.01)

(52) U.S. Cl.
USPC ..... 52/255; 52/254; 52/287.1; 52/288.1

(58) Field of Classification Search
USPC ..... 52/254, 255, 287.1, 288.1
See application file for complete search history.

(56) References Cited

U.S. PATENT DOCUMENTS

| | | | | |
|---|---|---|---|---|
| 269,018 | A | 12/1882 | Crowell et al. | |
| 354,342 | A | 12/1886 | Pratt | |
| 777,441 | A | 12/1904 | Small | |
| 844,861 | A | 2/1907 | Gill | |
| 1,192,027 | A | 7/1916 | Acheson | |
| 1,864,403 | A | 6/1932 | Bradley | |
| 2,012,203 | A * | 8/1935 | Peterson | 52/255 |
| 2,306,537 | A | 12/1942 | Hamm | |
| 2,529,855 | A * | 11/1950 | Waterman | 52/288.1 |
| 2,573,987 | A | 11/1951 | Sage | |
| 3,295,268 | A * | 1/1967 | Gaither | 52/97 |
| 3,323,264 | A * | 6/1967 | Cross | 52/281 |
| 3,449,874 | A | 6/1969 | Beaupre | |
| 3,726,054 | A | 4/1973 | Anderson et al. | |
| 3,757,475 | A | 9/1973 | Hackworth | |
| 3,881,694 | A | 5/1975 | Gardner | |
| 3,894,365 | A | 7/1975 | Abbott | |
| 4,079,556 | A | 3/1978 | Luck et al. | |
| 4,473,984 | A | 10/1984 | Lopez | |
| 4,722,153 | A * | 2/1988 | Hardy | 52/255 |
| 5,319,896 | A | 6/1994 | Winger | |
| 5,426,967 | A | 6/1995 | Sparlin | |
| 5,531,051 | A | 7/1996 | Chenier, Jr. et al. | |
| 5,537,786 | A | 7/1996 | Lozier et al. | |
| 5,638,570 | A | 6/1997 | Gruner | |
| 5,740,642 | A | 4/1998 | Koenig, Jr. et al. | |
| 5,752,353 | A * | 5/1998 | Koenig et al. | 52/255 |

(Continued)

OTHER PUBLICATIONS

Federal Alliance for Safe Homes (FLASH), "Animated How-To: Roof Systems", 2004. Animated audio/visual presentation on the FLASH website, http://www. flash. org/activity.cfm?currentPeril=3 &activityID=181, accesed Feb. 24, 2010. First page is FLASH.org home page showing link to "Roof". Next two pages contain the video player and the printed narrative for the animation. The remaining pages are screen shots captured from the animation video. 54 pages total.

(Continued)

*Primary Examiner* — Andrew J Triggs
(74) *Attorney, Agent, or Firm* — Gordon G. Waggett, P.C.

(57) ABSTRACT

A flexible bullnose corner member for covering an external corner intersection of two adjacent wall members, generally comprising a right side flange, a left side flange, a bullnose arcuate edge section, left and right shoulder stops connecting the respective flanges to the edges of the arcuate edge section, and an adjustable bullnose flange angle. Also described is an adjustable radius bullnose corner member having an architecturally radiused curvature along the length of its outer surface for mounting over and strengthening the structural integrity of two adjacent corner wall members of a structure and for receiving on its outer surface a wall plastering material such as stucco or the like. Perforations or other structural features may be employed to assist in retaining the stucco or other finishing material on the bullnose surface. Also disclosed is an L-shaped corner member for strengthening the intersection of two adjacent wall members forming a corner.

18 Claims, 7 Drawing Sheets

(56) References Cited

U.S. PATENT DOCUMENTS

| | | | | |
|---|---|---|---|---|
| 5,813,179 | A * | 9/1998 | Koenig et al. | 52/255 |
| 5,904,016 | A * | 5/1999 | Koenig et al. | 52/255 |
| 6,082,723 | A | 7/2000 | Matthews | |
| 6,125,546 | A | 10/2000 | Laws et al. | |
| 6,148,573 | A * | 11/2000 | Smythe, Jr. | 52/255 |
| 6,212,836 | B1 * | 4/2001 | Larson | 52/287.1 |
| 6,295,776 | B1 * | 10/2001 | Kunz et al. | 52/255 |
| 6,360,503 | B1 * | 3/2002 | Koenig, Jr. | 52/287.1 |
| 6,363,673 | B1 | 4/2002 | Robertson | |
| 6,385,939 | B1 | 5/2002 | Stout | |
| 6,427,418 | B1 * | 8/2002 | Zell | 52/745.05 |
| 6,438,914 | B1 | 8/2002 | Robertson | |
| 6,450,232 | B1 | 9/2002 | Smythe, Jr. | |
| 6,539,680 | B2 * | 4/2003 | Kunz et al. | 52/256 |
| 6,571,520 | B2 * | 6/2003 | Koenig et al. | 52/287.1 |
| 6,631,597 | B1 | 10/2003 | Rutherford | |
| 6,691,477 | B2 * | 2/2004 | Koenig et al. | 52/287.1 |
| 6,729,949 | B1 | 5/2004 | McCoy | |
| 6,777,063 | B2 | 8/2004 | Born | |
| 6,779,313 | B2 * | 8/2004 | Smythe, Jr. | 52/255 |
| 7,013,610 | B2 * | 3/2006 | Kunz | 52/255 |
| 2002/0035809 | A1 | 3/2002 | Smythe, Jr. | |
| 2002/0083665 | A1 * | 7/2002 | Razetto | 52/288.1 |
| 2002/0096977 | A1 | 7/2002 | Zenobio | |
| 2002/0134035 | A1 | 9/2002 | Koenig, Jr. et al. | |
| 2003/0021957 | A1 | 1/2003 | Born | |
| 2003/0192273 | A1 | 10/2003 | Koenig, Jr. et al. | |
| 2005/0055963 | A1 | 3/2005 | Smythe, Jr. | |
| 2006/0059809 | A1 | 3/2006 | Smythe, Jr. | |
| 2007/0094996 | A1 | 5/2007 | Young | |
| 2007/0125020 | A1 | 6/2007 | Young | |
| 2008/0066403 | A1 * | 3/2008 | Koenig et al. | 52/255 |
| 2008/0196340 | A1 | 8/2008 | Smythe | |

OTHER PUBLICATIONS

FEMA, Home Builders Guide to Coastal Construction, FEMA 499/ Aug. 2005, Technical Fact Sheet No. 9 entitled: "Moisture Barrier Systems". 2 pages. Accessed online on Feb. 24, 2010 from http:// www. fema. gov/library/viewRecord.do?id=1570.

FEMA, Home Builders Guide to Coastal Construction, FEMA 499/ Aug. 2005, Technical Fact Sheet No. 10 entitled: "Load Paths". 2 pages. Accessed online on Feb. 24, 2010 from http:// www. fema .gov/library/viewRecord.do?id=1570.

FEMA, Home Builders Guide to Coastal Construction, FEMA 499/ Aug. 2005, Technical Fact Sheet No. 17 entitled: "Use of Connectors and Brackets". 4 pages. Accessed online on Feb. 24, 2010 from http:// www. fema. gov/library/viewRecord.do?id=1570.

FEMA, Home Builders Guide to Coastal Construction, FEMA 499/ Aug. 2005, Technical Fact Sheet No. 24 entitled:."Roof-to-Wall and Deck-to-Wall Flashing". 3 pages. Accessed online on Feb. 24, 2010 from http:// www. fema. gov/library/viewRecord.do?id=1570.

FEMA, Home Builders Guide to Coastal Construction, FEMA 499/ Aug. 2005, Technical Fact Sheet No. 25 entitled: "Siding Installation and Connectors". 2 pages. Accessed online on Feb. 24, 2010 from http:// www. fema. gov/library/viewRecord.do?id=1570.

American Forest & Paper Association, American Wood Council, "Details for Conventional Wood Frame Construction", 2001, 55 pages.

Sherwood, G.E. and Stroh, R.C., USDA Forest Service Agricultural Handbook 73 "Wood-Frame House Construction", Chapter 3, "Framing and closing in", pp. 38-97, Sep. 1989. 69 pages.

USDA Forest Service, Forest Products Laboratory, 2-page webpage screenshot, printed Feb. 27, 2008.

Excerpts from online Simpson Strong-Tie 2009 catalog, (printed from strongtie.com / ftp /catalogs/C-2009/C-2009). 6 pages.

Federal Alliance for Safe Homes (FLASH), "Animated How-To: Wall Construction", 2004. Animated audio/visual presentation on the FLASH website, http:// www. flash..org/activity.cfm?currentPeril=1 &activityID=180, accesed Feb. 24, 2010. First page is FLASH.org home page showing link to "Walls". Next two pages contain the video player and the printed narrative for the animation. The remaining pages are screen shots captured from the animation video. 65 pages total.

Weber, Mark, "A Smart Way to Frame a Corner", Extreme How-To, The Enthusiast's Guide to Home Improvements, http:// www. extremehowto.com /xh/article.asp?article_id=60256, Accessed Feb. 27, 2008. 12 pages.

AMICO Metal Lath and Accessories Catalog (1/08). Amico (Alabama Metal Industries Corporation), a Gibralter Industries Company. http://amico-lath. com/pdf/AMICO%20Vinyl%20Bead%20catalog. pdf. 36 pages. Accessed Apr. 7, 2009.

AMICO Vinyl Bead Accessory Catalog (Jun. 2008). Amico (Alabama Metal Industries Corporation), a Gibralter Industries Company. http:// amico-lath.com /pdf/Metarl20%Lath%20Catalog.pdf. 19 pages. Accessed Mar. 6, 2010.

Screenshot excerpts from AMICO (Alabama Metal Industries Corporation) website, www. amico-lath.com. 14 pages. Accessed Apr. 1, 2009.

Screenshot from AMICO (Alabama Metal Industries Corporation) website, http:// amico-lath.com /eifs/cornerbead.htm. "Vinyl > RIFS > Corner Bead", 1 page. 2005. Accessed Mar. 6, 2010.

Screenshot from AMICO (Alabama Metal Industries Corporation) website, http:// amico-lath.com /faqs.htm. "Frequently Asked Questions", 2 pages. Accessed Mar. 6, 2010.

Premier Concrete Products, Inc., website excerpt "architectural masonry block", http:// www. premier-concrete. com/ architectural-masonry.php (6 pages), Accessed Feb. 28, 2008.

United States Gypsum Company, Plastering Materials, "Recommended Installation of Bullnose Corners with Veneer Plaster Systems", Dec. 1992, PM13. 2 pages.

Michigan Prestain, "Dura-Log" siding "Exterior Log Siding Products". Webpage from http:// www. duralog. com/ log_siding.asp, 2 Pages. Accessed Feb. 27, 2008.

KC Supply Co. "DW Wire Corners". Webpage from http: //www. kcsupplyco. com/trim.html (3 pages). Accessed Feb. 28, 2008.

HGTVPro.com, "Three-Stud Corner Framing". Webpage from http:// www. hgtvpro.com/hpro/cda/article_print/...PRO_20147_ 3463189_ARTICLE-DETAIL-PRINT,00.html (2 Pages.). Accessed Feb. 27, 2008.

K-Lath, a division of Tree Island Wire, USA, Inc., "Welded and Woven Wire Products Staple and Nail Products" brochure 2005. 2 pages. Available online at http: //www. klath.com/snapfiles/Brochures/K-Lath_Brochure_2005.pdf.

Niles Building Products Company, "Corner Beads and Casing Beads", webpage from http:// www. nilesbldg.com/ corner.html (4 pages). Accessed Mar. 3, 2008.

Niles Building Products Company, "Product Specifications", webpage from http:// www. nilesbldg.com/specs.html (2 pages). Accessed Mar. 3, 2008.

Accent Quality Stucco Products, "One Coat Stucco Details", Available from http:// www. rydarinc. com/pdfs/details/ OneCoat.pdf (15 pages). Accessed Feb. 28, 2008.

Phillips Manufacturing Co., excerpts (13 pages) from website phillipsmfg.com, "Bullnose Corner Beads" http:// www. phillipsmfg. com/products/mbt/bull_com.htm (11 pages) and "Stucco, Veneer & Plaster Beads & Trims" http:// www. phillipsmfg.com/products/ svpbt/index.htm (2 pages). Accessed Apr. 7, 2009.

Wert, Bryan. "Coming Up with Tie-downs". Structure magazine, Nov. 2009. Available from http:// www. strongtie. com/ftp/articles/ STRUCTURE_Rod-System-Article_Nov2009.pdf. (7 pages).

Simpson Strong-Tie 2009 "High Wind-Resistant Construction" catalog C-HW09, (printed from http:// www. strongtie.com/ftp/catalogs/ c-hw09/C-HW09.pdf). 44 pages.

Mattison, Jim. "Framing Hardware Dos and Dont's". JLC. p. 1-6. Nov. 2009. Available from http:// www. strongtie. com/ftp/articles/ JLC_Article_Framing%20Hardware_Nov2009.pdf. 6 pages.

Shackelford, Randy and Prior, Steve. "Design Solutions for Wood-Frame Multi-Story Buildings—Resisting Uplift and Lateral Forces". Construction Specifier magazine. p. 1-19. Aug. 2007. Available from http:// www. strongtie.com/ftp/ articles/WoodFrameMultiStory-article.pdf. 19 pages.

(56) References Cited

OTHER PUBLICATIONS

Stockton Products, "Metal Products" website excerpt from http:// www. stocktonproducts.com/DMetalProducts.cfm?UserID=5 (2 pages) Accessed Feb. 28, 2008.
Stockton Products, "Metal Products" website excerpt from http:// www. stocktonproducts.com/dmetalproducts.cfm?userid=5 &pageView=Desc (4 pages) Accessed Feb. 28, 2008.
Stockton Products, "Bullnose" website excerpt p. 3 from http:// www. stocktonproducts.com/PDFframes.cfm?id=53 (1 page). Accessed Feb. 28, 2008.
Stockton Products, "Products Questions" website excerpt from http:// www. stocktonproducts.com/wireapp.cfm?UserId=5 (2 pagea). Accessed Feb. 28, 2008.
Stockton Products, "Application Methods Common to All Wire Products—Application of Corneraid", website excerpt from http:// www. stocktonproducts.com/ProductQ.cfm (2 pages). Accessed Feb. 28, 2008.
Johnson County Kansas Unincorporated Building Codes, Olathe, Kansas. "Stucco Application Guidelines". Available from http:// buildingcodes.jocogov.org/documents/Stucco.pdf. 20 pages. Accessed May 29, 2001.
Simpson Strong-Tie, Technical Bulletin, "Companion for the 2001 AF&PA Wood-Frame Construction Manual for Wind Design". 24 pages. Sep. 30, 2008. Available from: http:// www. strongtie. com/ ftp/bulletins/T-01WFCM08.pdf. Accessed May 13, 2009.
Trim-Tex Drywall Products, webpage excerpts regarding "350 Bull" corner bead products. Available from: http:// www.trim-tex.com/ 350bull.htm (8 pages). Accessed May 26, 2009.
IRLY Building Centres, Gypsum and Accessories, "01 Building Materials" website excerpts. Available from: http://www. irly.ca/irly/ corp/0140.HTM (5 pages). Accessed Feb. 28, 2008.
Vinyl Corp. "Stucco & Plaster Accessories". Webpages from http:// www. vinylcorp.com/products/stuccoplast01.asp (2 pages). Accessed Apr. 7, 2009.
Westover, Philip "The Strength of Plywood Sheathing" (undated but believed to be prior art) obtained online from http://mgacon0.tripod. com/plywood.htm on May 16, 2012.
BYI Today—Buid it Yourself Today—"How to Install Exterior Sheathing" (undated but believed to be prior art) obtained online from http://biytoday.com/exteriorsheathing.htm on May 17, 2012. 5 pages.

* cited by examiner

ADJUSTABLE RADIUS BULLNOSE CORNER

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

1. Field of Use

This invention pertains generally to a corner member used in connection with the application of a stucco or stucco-like finish to a structure to create a rounded external corner edge, sometimes referred to as a bullnose corner. This invention also pertains to a corner member used in connection with securing adjacent wall members together.

2. Background Technology

U.S. Pat. No. 6,779,313 as well as U.S. Patent Application Nos. 20060059809A1, 20050055963A1 and 20020035809A1 each entitled "Boxable drywall corner bead" to Smythe, Jr. pertain to a boxable corner bead for finishing drywall corners that is made from two flanges with a protruding nose section. This bead can be made in regular, bullnose, or flex trim type arrangements. Once the bead is attached to a drywall corner, it can be mudded on both sides of the corner without waiting for the mud on the first side to dry. This is because of the shape of the nose which allows a mud dispensing box to apply mud on one side without getting mud on the nose. The box can then be immediately moved to the other side, where that side can be mudded. The nose itself is prepared to directly receive paint or texture, and hence does not need any mud. The flex-trim version has a raised trapezoidal section with a V-groove cut in the back. The bead hinges around the V-groove to match any corner angle. Both sides can be mudded as with the fixed bead. The beads can be used with both interior and exterior corners.

U.S. Pat. No. 6,450,232 entitled "Drywall finishing roller and edge finisher" to Smythe, Jr. pertains to a drywall finishing system for inside and outside drywall corners including regular corners and bullnose corners. A special roller tool with a flexible frame and four rollers is used to press prefabricated drywall trim into place over a coating of drywall mud. Embodiments for inside and outside corners differ in that the rollers for inside corners are opposed and those for exterior corners are open, in both cases forming an angle of 84 to 87 degrees but able to flex from 84 degrees to over 97 degrees to match an corner angle. A special edge finisher mud box then allows the tapered edges of the trim pieces to be feathered and brought to a finished state. The mud box has several different front slots for coarse and final feathering.

U.S. Patent Application No. 20080196340A1 entitled "Arch drywall trim product" to Smythe pertains to a notched drywall trim piece that can take the form of a bead, hinged trim piece or bullnose piece that generally is constructed from a semi-rigid core that forms two flanges. At least one of the flanges is notched allowing the piece to follow the shape of an arch or arbitrarily curved corner. The product can generally be installed without any mechanical fasteners since the inner or wall-facing surface of the product is prepared or treated to bond directly with drywall mud or other mastic. In this manner, the piece can be installed using only wet mud or other mastic. The installation process can be aided by the use of a corner roller common in the industry to help set and align the material with the corner being trimmed. The outer or room-facing surface can optionally be treated or prepared to bond with the mud or can be prepared to directly receive paint or texture. The preparation of the flange surface can take the form of a paper or other fibrous layer, scoring, frocking (bonding a powered fibrous material), roughing, protrusions, or a water-activated adhesive or pressure sensitive (or any other) adhesive may be used.

U.S. Pat. No. 6,777,063 and U.S. Patent Application No. 20030021957A1 entitled "Composite backerboard for bullnose support" to Born pertain to backerboards comprising a shaped cut or groove the allows bending of the backerboard into an L-shaped corner with a rounded outer surface and sharp inner surface are useful for supporting bullnose tile pieces.

U.S. Pat. No. 6,729,949 entitled "Sanding and cleaning device for drywall bullnose cornerbeads" to McCoy pertains to a device for abrading and finishing excess cured filler material from a bullnose cornerbead which forms an outside corner joint between immediately adjacent sheets of drywall. The device includes an elongated rigid body having a generally concave-shaped central longitudinal surface which receives a highly compressible thick foam-backed abrasive member which is preferably substantially coextensive with, and arcuately compressibly formable to match, the radiused bullnose joint contour. Two sets of spaced guide rollers extend longitudinally of the device adjacent each side margin of the longitudinal surface which, in cooperation with the compressible abrasive member, is matingly engageable against the bullnose corner to substantially match the outside corner angle between the adjacent drywall sheets when the device is pressed firmly against the bullnose corner.

U.S. Pat. Nos. 6,691,477 and 6,571,520 as well as U.S. Patent Application Nos. 20030192273A1 and 20020134035A1 each entitled "Drywall-trimming strip having bullnose portion with minimal set-back requirement" to Koenig. Jr., et al. provide that as extruded from a polymeric material, such as polyvinyl chloride, a drywall-trimming strip has a central portion, which has a bullnose region and two planar regions, one at each side of the bullnose portion. Further, the drywall-trimming strip has two lateral flanges, each of which is joined unitarily to the bullnose portion by a stepped junction. The bullnose region has an exterior radius of 0.350 inch approximately. Each planar region has a width of 0.217 inch approximately, as measured in a plane normal to an axis defined by the bullnose region. Each junction has a measurement of 0.095 approximately, as measured between a plane defined by the exterior surface of the bullnose portion and a plane defined by the interior surface of the flange at such junction. Having a thickness of 0.055 inch approximately, the strip is adapted to fit along an elongate corner defined by two drywall panels, each of which has a thickness not less than 0.5 inch approximately and each of which is disposed against an interior surface of one of the lateral flanges, while permitting a first panel to abut or to be closely spaced from a second panel without requiring the second of panel to be set back from a plane defined by an outer surface of the first panel, by a distance larger then 0.091 inch approximately, so as to avoid interference with the bullnose portion.

U.S. Pat. No. 5,740,642 entitled "Drywall corner-trimming assembly resisting butt-edge separation" to Koenig, Jr., et al. provides that in a drywall corner-trimming assembly providing a "bullnose" configuration, two corner-trimming members and a splice are combined. Each member has a central portion and two flanged portions. The central portion has a generally arcuate profile. Each of the flanged portions extends from one of the lateral edges of the central portion at a step defining a lateral limit of a concave surface of the central portion. The members and the splice are assembled so that the splice straddles such members, so that a portion of one of the expansive surfaces of the splice faces the concave surface of the central portion of each of such members, so that the splice is concealed at least substantially by the central portions of such members are viewed, and so that each of the lateral edges of the elongate splice is pressed firmly against the step at one of the lateral edges of the central portion of each of said members. The splice is secured adhesively to the members, as by adhesive ribbons.

U.S. Pat. No. 5,531,051 entitled "Connector clip for corner bead" to Chenier, et al., pertains to an extruded strip joining system including a strip and a clip which cooperate to join free ends of extruded strips in precise abutment to maintain alignment of the strips. The strip joining system includes the strip which has an elongated junction portion and at least one elongated flange extending parallel to and away from the junction portion. The junction portion includes an internal surface and an external surface. Protruding structures are provided on the internal surface of the junction portion. A pair of axially elongated tabs are formed on the protruding structures depending from internal surface of the junction portion. The tabs are axially elongated along the strip and extend inwardly defining a channel therebetween. The clip is configured to engage the tabs thereby retaining the clip in the channel. Two strips are positioned with free ends abutting each other and a clip is positioned over the channel and pressed into engagement with the tabs. Engagement of the clip with the tabs provides precise end-to-end positioning and axial alignment of the strips.

U.S. Pat. No. 6,631,597 entitled "Bullnose base/crown corner plug" to Rutherford pertains to a corner plug that is disclosed for filling a cavity created between a wall corner bullnose and a squared-off molding, having an upper portion and a lower portion, both portions having a concave back surface. A shoulder formed at the intersection of the upper and lower portions is dimensioned to traverse and cover the cavity between the wall corner bullnose and the squared-off molding. In one embodiment of the present invention, the back surface is dimensioned to continuously contact the wall corner bullnose. The upper portion is preferably thicker than the lower portion and the lower portion preferably tapers to facilitate the insertion of the plug into the cavity. In one embodiment of the invention, the front surface of the lower portion includes two planar members that intersect at an edge, corresponding to the edge portion of the molding. The corner plug can be constructed from any rigid material, including plastic, wood, metal, or other similar material.

U.S. Pat. Nos. 6,438,914 and 6,363,673 both entitled "Drywall trim piece" to Robertson pertain to a trim piece for installing at a drywall external right angle corner which is provided with a bullnose corner bead includes an intermediate portion which wraps over the convexly curved portion of the bullnose corner bead and has two edges extending parallel to the edges of the flanges of the corner bead. Two leaves are attached to the intermediate portion of the trim piece at the two edges respectively. The intermediate portion of the trim piece has an interior surface at a first end matching closely the exterior surface of the corner bead and an exterior surface which is convexly curved at the first end and is right-angled at the opposite second end and provides a transition from the convex curve to the right angle between the first and second ends.

U.S. Pat. No. 6,385,939 entitled "Bullnose cladding system" to Stout pertains to a bullnose cladding system is provided which gives an outward appearance of a generally arcuate or semi-circular surface extending from an otherwise planar surface. The bullnose cladding system is constructed using a pair of parallel mounting rails which hold one or more outwardly bowed flexible plastic panels. The longitudinal edges of the plastic panels are folded under to create a hem which releasably secures the panel within the longitudinal rails. Various corner members and expansion joints may be utilized to provide a finished look to the bullnose cladding system.

U.S. Pat. No. 6,125,546 entitled "Bullnose corner bead shear" to Laws, et al. pertains to a bullnose corner bead shear for making internal angle corner cuts to bullnose corner bead. The device includes a first cutting head having a first cutting member and a second cutting member, the first cutting member further comprising a cutting blade having a linear cutting edge portion and a curvilinear cutting edge portion, the second cutting member further comprising a cutting blade having a linear cutting edge portion and a curvilinear cutting edge portion, the first and second cutting member cutting blade curvilinear edge portions being contoured in such manner that they extend in a first direction distal of a line of the corresponding linear cutting edge portion and a second direction perpendicular to a plane of the corresponding cutting member, a handle assembly having a first handle and a second handle, the first handle being attachable to a first cutting member leg and the second handle being attachable to a second cutting member leg, and a pivot pin for pivotally attaching the first cutting member and the second cutting member such that when the first handle and the second handle are biased toward each other the first cutting member cutting blade cuttably engages the second cutting member cutting blade.

U.S. Pat. No. 6,082,723 entitled "Tile cap base for cutting pre-defined angles" to Matthews relates to a device for holding tile during cutting to obtain defined angles, preferably 45 degree angles. The present invention further encompasses a method for using such a device in combination with a table-style tile cutter, preferably one using a roller tray with a lip, to cut defined angles into various orientations of tile and, more specifically, tile caps. The device comprises a base having a bottom and at least two straight edges that meet in a right angle in a corner of the base. In its preferred embodiment the base includes two grooves. One of the grooves includes a curved section shaped to mirror and support the concave side of the curved nose of a standard bullnose tile cap. The other groove includes a curved section shaped to mirror and support the convex side of the curved nose of a standard bullnose tile cap. These grooves allow for holding and supporting tile as aligned by the base for cutting pre-defined angles into various orientations of the tile. Alternative embodiments may include only one or the other of the two grooves.

U.S. Pat. No. 5,638,570 entitled "Drywall bullnose cleaner tool" to Gruner pertains to a tool for scraping material from a bullnose installed on a corner joint of a drywall installation includes an elongated device having a handle portion, a first end portion, a second end portion, and a size adapted for holding in one hand. The first end portion has a first convexly shaped edge that matches a concavely shaped portion of the bullnose. It enables a user to scrape the material from the bullnose by moving the convexly shaped edge along the concavely shaped portion of the bullnose. Preferably, the first concavely shaped edge is shaped in a 75-degree arc of 0.875 inch radius to match a convexly shaped portion of the bullnose when the bullnose is installed on a 90-degree corner joint, and the second end portion of the elongated device includes a second convexly shaped edge that is shaped in a 50-degree arc of 1.125 inch radius to match the concavely shaped portion of the bullnose when the bullnose is installed on a 135-degree corner joint. One embodiment takes the form of a 6.5 inch long aluminum bar having the specified shaped.

U.S. Pat. No. 5,426,967 entitled "Apparatus and method for forming bullnose corner bead" to Sparlin pertains to a portable apparatus for inexpensively forming plain angle ends of bullnose corner beading includes a base; an external die on the base; a pair of retainers for symmetrically holding opposite leg extremities of the corner bead relative to the external die; an internal die pivotally supported relative to the base for movement between open and closed positions for forming the end portion of the corner bead into the plain angular shape; a handle and link mechanism for operating the internal die; and a stop member rigidly located relative to the base for providing a predetermined length of the end portion. The retainers can be adjustable relative to the external die for accommodating corner bead having different flange widths, the retainers being movable symmetrically relative to a dihedral apex of the external die member. In another aspect of the invention, a method for forming the corner bead includes the steps of providing the corner bead having uniform bullnose cross-section; supporting the end portion of the corner bead against an external die; retaining opposite leg extremities of the corner bead in a laterally symmetric position relative to the external die; and driving an internal die into proximity with the exterior die whereby the planar surfaces of the interior die come into closely spaced relation to the external die over a predetermined distance for forming the end portion of the corner bead.

U.S. Patent Application No. 20070125020A1 entitled "Trim molding system and apparatus" to Young pertains to a trim molding system including trim pieces having a tab and corresponding keyway system. The tab fits into the keyway. Trim boards having keyways are configured to be joined to a corner cap having tabs to provide a trim system that is suitable for use with bullnose corner bead. Trim boards having are configured to be spliced using a splice tab that both joins and aligns the trim boards. Trim boards having keyways are configured to be joined at a corner using an angled corner tab that both joins and aligns the trim boards, and conforms to a corner angle of a surface such as a wall.

U.S. Patent Application No. 20070094996A1 entitled "Trim piece" to Young pertains to a trim piece for installing at a corner, either inside or outside, which has a bullnose corner bead. An exemplary embodiment of the trim piece includes a body that wraps over the convexly curved portion of the bullnose corner bead and at least one flange extending parallel to the edges of the flanges of the corner bead. The two flanges are attached to the trim piece at the two edges respectively. The trim piece has an interior surface matching closely the exterior surface of the corner bead and an exterior surface which is both convexly curved to match the convex bullnose corner bead and molded to match the exterior profile of the trim such that a smooth transition from trim board around the corner to the outer trim board results.

U.S. Patent Application No. 20020096977A1 entitled "Counter corner system" to Zenobio pertains to a counter corner system that allows two standard counter tops to be joined at a corner without the need to notch or miter the counter tops has a body member that has four sides and a notch that joins the first side with the second side. The notch has a pair of edges that are normal to each other. A bullnose shaped portion extends downwardly from the body member and begins at the edges of the notch, the body member and bullnose shaped member being monolithic in construction. One of the counter tops abuts the first side of the body member such that the forward facing side of the counter top lies on the same plane of one of the edges of the notch and the second counter top abuts the second side of the body member such that the forward facing side of this counter top lies on the same plane as the other edge of the notch.

SUMMARY OF INVENTION

In one embodiment of the present invention there is disclosed and described a flexible, elongate bullnose corner member for covering an external corner intersection of two adjacent wall members of a structure comprising: a top side, a bottom side, a right side flange, a left side flange, a generally rectangular bullnose arcuate edge section and left and right side lips or shoulder stops connecting the respective flanges to the edges of the arcuate edge section, and an adjustable bullnose flange angle defined as the angle between the right side flange inner surface and the left side flange inner surface.

The right side flange has a right side flange outer edge and a right side flange inner edge opposite the right side flange outer edge, a right side flange upper edge extending between the right side flange outer edge and the right side flange inner edge, the right side flange upper edge intersecting with the right side flange outer edge at a right side flange upper edge outside end, the right side flange upper edge also intersecting with the right side flange inner edge at a right side flange upper edge inside end, a right side flange lower edge extending between the right side flange outer edge and the right side flange inner edge, and being opposite the right side flange upper edge, the right side flange lower edge intersecting with the right side flange outer edge at a right side flange lower edge outside end, the right side flange lower edge also intersecting with the right side flange inner edge at a right side flange lower edge inside end, a width defined as the distance between the right side flange inner edge and the right side flange outer edge, and a right side flange outer surface forming part of the bullnose corner member top side and a right side flange inner surface forming a part of the bullnose corner member bottom side.

The left side flange has a left side flange outer edge and a left side flange inner edge opposite the left side flange outer edge, a left side flange upper edge extending between the left side flange outer edge and the left side flange inner edge, the left side flange upper edge intersecting with the left side flange outer edge at a left side flange upper edge outside end, the left side flange upper edge also intersecting with the left side flange inner edge at a left side flange upper edge inside end, a left side flange lower edge extending between the left side flange outer edge and the left side flange inner edge, and being opposite the left side flange upper edge, the left side flange lower edge intersecting with the left side flange outer edge at a left side flange lower edge outside end, the left side flange lower edge also intersecting with the left side flange inner edge at a left side flange lower edge inside end, a width defined as the distance between the left side flange inner edge and the left side flange outer edge, a left side flange outer surface forming a part of the bullnose corner member top side and a left side flange inner surface forming a part of the bullnose corner member bottom side.

The bullnose arcuate edge section has a bullnose right edge and a bullnose left edge opposite thereto, a bullnose upper curved end extending between the bullnose right edge and the bullnose left edge, the bullnose upper curved end intersecting with the bullnose right edge at a bullnose upper end right side corner, the bullnose upper curved end intersecting with the bullnose left edge at a bullnose upper end left side corner, a bullnose lower curved end opposite the upper curved end extending between the bullnose right edge and the bullnose left edge, the bullnose lower curved end intersecting with the bullnose right edge at a bullnose lower end right side corner, the bullnose lower curved end intersecting with the bullnose left edge at a bullnose lower end left side corner, a convex-shaped bullnose outer surface and a bullnose inner surface.

In this embodiment, the bullnose corner member has a generally rectangular bullnose right side lip extending between the right side flange inner edge and the bullnose right edge, the bullnose right side lip left edge sharing the same edge as the bullnose right edge, the bullnose right side lip right edge sharing the same edge as the right side flange inner edge, a bullnose right side lip top edge extending between the right side flange upper edge inside end and the bullnose upper end right side corner, a bullnose right side lip bottom edge extending between the right side flange lower edge inside end and the bullnose lower end right side corner, a bullnose right side lip top surface and a bullnose right side underside surface, a width defined as the distance between the right side flange inner edge and the bullnose right edge, the bullnose right side lip meeting the right side flange at a desired right side lip/flange intersection angle.

The bullnose corner member of this embodiment also has a generally rectangular bullnose left side lip extending between the left side flange inner edge and the bullnose left edge, the bullnose left side lip right edge sharing the same edge as the bullnose left edge, the bullnose left side lip left edge sharing the same edge as the left side flange inner edge, a bullnose left side lip top edge extending between the left side flange upper edge inside end and the bullnose upper end left side corner, a bullnose left side lip bottom edge extending between the left side flange lower edge inside end and the bullnose lower end left side corner, a bullnose left side lip top surface and a bullnose left side underside surface, a width defined as the distance between the left side flange inner edge and the bullnose left edge, the bullnose left side lip meeting the left side flange at a desired left side lip/flange intersection angle.

In one embodiment, the bullnose corner member left and right side lip/flange intersection angles range between about 45 degrees and 135 degrees. In another embodiment, the left and right side lip/flange intersection angles are ninety degrees. In one embodiment, the left and right side lip surfaces are generally planar in shape; in another embodiment, the left and right side lip surfaces are generally concave in shape; and in yet another embodiment, the left and right side lip surfaces are generally V-shaped troughs.

The bullnose corner member's left and right side lip surfaces can, if desired, contain structural features to retain or adhere stucco. These structural features include, for example, surface divots, dimples, perforations, roughening, etching lines, striations, and/or corrugations or the like.

In another embodiment of the present bullnose corner member invention, the adjustable bullnose flange angle ranges between about 45 degrees and 135 degrees. In another embodiment, the adjustable bullnose flange angle is 90 degrees.

The bullnose corner member's left side flange and/or the right side flange may contain one or more flange perforations; the left side lip and/or the right side lip may contain one or more lip perforations; and/or the bullnose arcuate edge contains may contain one or more bullnose edge perforations. The perforations on the flange can serve as nailing holes and/or as structural features that enhance the adhesion of the plastering layer over the outer surface of the flange. The perforations on the lips or arcuate edge serve as structural features that enhance the adhesion of the plastering layer over the outer surfaces of the lips or arcuate edge, respectively.

The bullnose corner member of the present invention can be constructed out of many different materials, such as, materials selected from the group consisting of: metals, plastics, vinyls and elastomeric compounds, solid metal material, plastic material such as cpvc, alloys such as titanium, zinc and aluminum alloys, HST aluminum, 431 stainless steel, 17-4 stainless steel, Ti-alloy, galvanized steel, maraging metal, bi-metal, tungsten insert, injection molded plastics, ceramics, graphite, boron, KEVLAR® material and other synthetic materials, carbon fiber, resin, fiberglass, composites, wood, laminated wood, and compositions thereof.

In one embodiment of the present invention, the outer surfaces of the left side flange, right side flange, right side lip, left side lip, and/or the bullnose arcuate edge contain structural features to enhance the adhesion/adherence of the stucco to such outer surfaces, including surface dimples, scratches, etches, striations, perforations, and/or corrugations.

In another embodiment, the bullnose corner member's right and left flange inner edges are joined or otherwise attached together to form a flange/lip intersection seam. This joinder or attachment can be accomplished in many different ways known in the art such as, for example, by welding, gluing, spot welding, via extrusion as a unitary construction, or via other suitable techniques.

In another embodiment of the present invention, there is disclosed and described an adjustable radius bullnose corner member having an architecturally radiused curvature along the length of its outer surface for mounting over and strengthening the structural integrity of two adjacent corner wall members of a structure and for receiving on its outer surface a wall plastering material such as stucco or the like used to finish the corner to match the finish of the two adjacent wall members. In this embodiment, the bullnose corner member comprises a radiused bullnose arcuate outer surface running the length of the bullnose corner member, the bullnose arcuate outer surface having two opposed parallel right and left side edges, a central curved section flanked by two linear left and right planar sections extending to the left and right side bullnose arcuate outer surface edges, respectively, the central curved section having left and right endpoints, the distance between such endpoints defining a chord having a chord length, the central curved section being flexible to permit adjusting the chord length during installation of the bullnose corner member over the two adjacent corners.

In this embodiment, the bullnose corner member also has a substantially rectangular right side shoulder stop having two opposed parallel top and bottom right side shoulder stop edges, the top right side shoulder edge attached to and extending downwardly from the bullnose arcuate outer surface right side edge at a bullnose top right side shoulder stop/bullnose right edge inside intersection angle ranging between about 135 degrees and about 45 degrees, and a substantially rectangular left side shoulder stop having two opposed parallel top and bottom left side shoulder stop edges, the top left side shoulder edge attached to and extending downwardly from the bullnose arcuate outer surface left side edge at a bullnose top left side shoulder stop/bullnose left edge inside intersection angle ranging between about 135 degrees and about 45 degrees.

The bullnose corner member of this embodiment also has a substantially rectangular right side attachment flange having two opposed parallel inside and outside right side flange edges, the inside right side flange edge attached to and extending outwardly from the bottom right side shoulder stop edge at a right side shoulder/flange intersection angle ranging between about 45 degrees and about 135 degrees, and a substantially rectangular left side attachment flange having two opposed parallel inside and outside left side flange edges, the inside left side flange edge attached to and extending outwardly from the bottom left side shoulder stop edge at a left side shoulder/flange intersection angle ranging between about 45 degrees and about 135 degrees. The bullnose top right side shoulder stop/bullnose right edge inside intersection angle and the right side shoulder/flange intersection angle add up to be about 180 degrees, the bullnose top left side shoulder stop/bullnose left edge inside intersection angle and the left side shoulder/flange intersection angle add up to be about 180 degrees. The bullnose outer surface left and right planar sections are substantially parallel to the respective left and right flanges when the bullnose corner member is mounted over the two adjacent wall members.

In another embodiment of the adjustable radius bullnose corner member, the bullnose top right side shoulder stop/bullnose right edge inside intersection angle is about 90 degrees, the bullnose top left side shoulder stop/bullnose left edge inside intersection angle is about 90 degrees, the right side shoulder/flange intersection angle is about 90 degrees, and the left side shoulder/flange intersection angle is about 90 degrees.

The present invention also pertains to a corner member for strengthening abutting walls that meet in a corner of a structure comprising: a first elongate flange section having top, bottom, right side and left side edges, and a second elongate flange section having top, bottom, right side and left side edges, wherein the first elongate flange right side edge is joined to the second elongate flange left side edge to form an elongate flange intersection angle that can range from between about 60 degrees to about 120 degrees. This corner member's first and/or second elongate flange sections contain one or more elongate flange perforations.

BRIEF SUMMARY OF DRAWINGS

The accompanying drawings, which are incorporated in and constitute a part of the specification, illustrate preferred embodiments of the invention. These drawings, together with the general description of the invention given above and the detailed description of the preferred embodiments given below, serve to explain the principles of the invention.

It will be appreciated that the foregoing drawings illustrate only certain embodiments of the invention and that numerous other variations may be created within the scope of the described invention.

DETAILED DESCRIPTION OF INVENTION

The above general description and the following detailed description are merely illustrative of the subject invention and additional modes, advantages and particulars of this invention will be readily suggested to those skilled in the art without departing from the spirit and scope of the invention.

Figure 1:
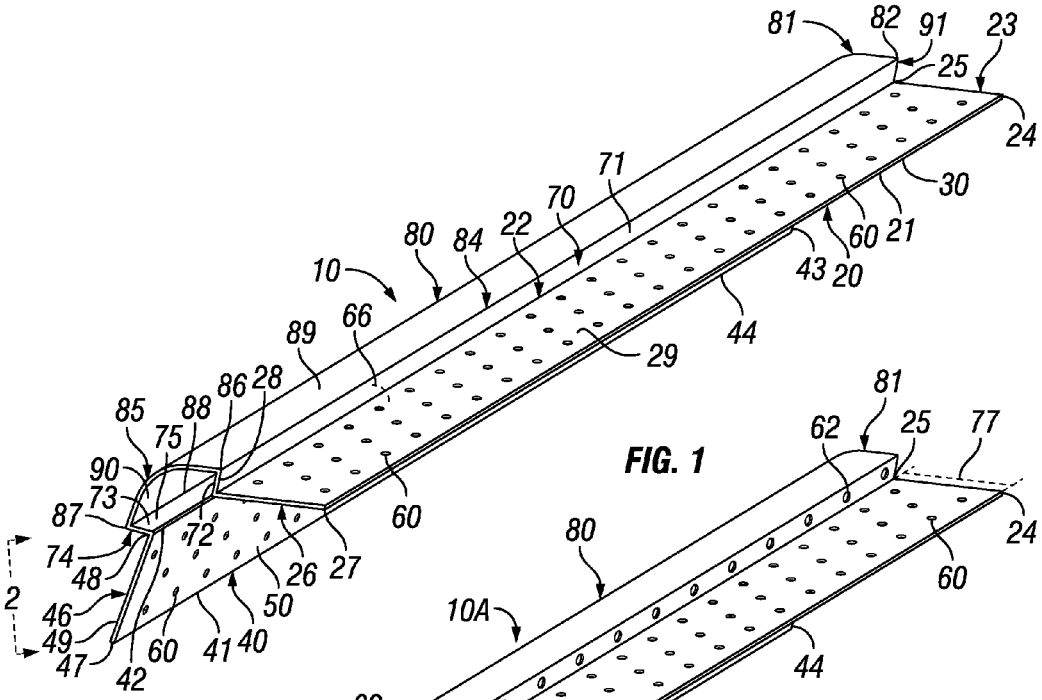
FIG. 1 illustrates a perspective view of an embodiment of an elongate bullnose corner member according the present invention.
Figure 1A:
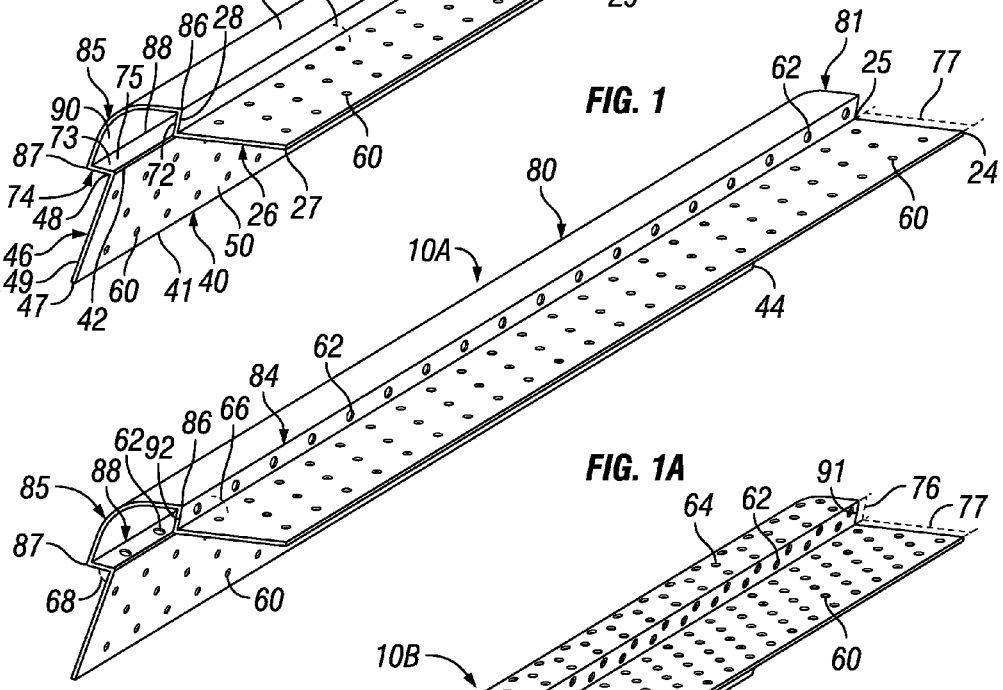
FIG. 1A illustrates a perspective view of another embodiment of an elongate bullnose corner member according the present invention.
Figure 1B:
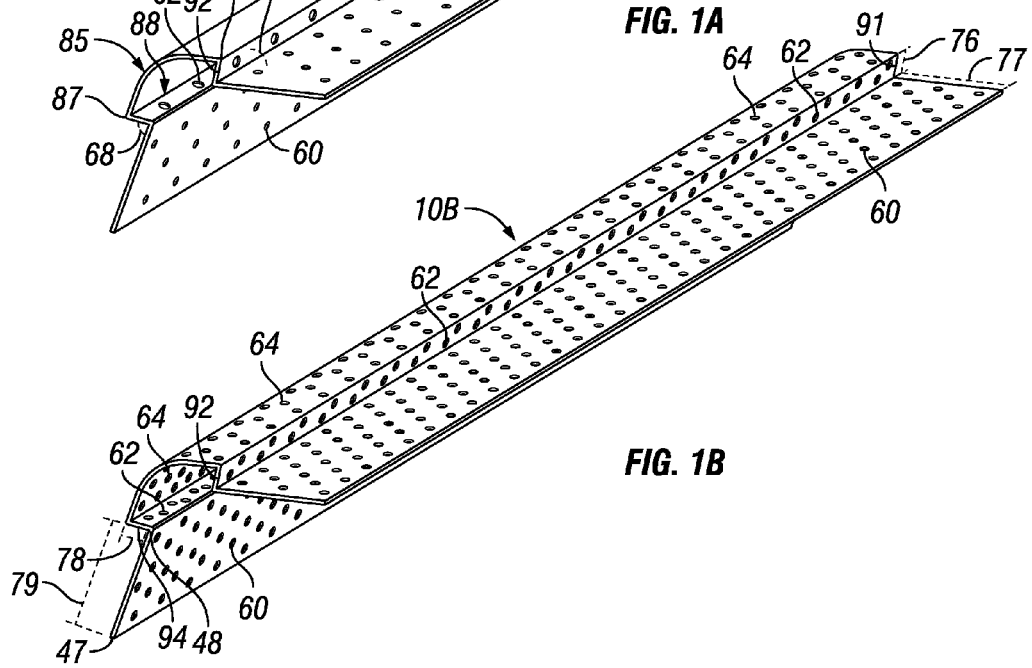
FIG. 1B illustrates a perspective view of another embodiment of an elongate bullnose corner member according the present invention.

Referring now to FIGS. 1, 1A and 1B there are shown various embodiments of a flexible elongate bullnose corner member 10, 10A, 10B according to the present invention each having a top side and a bottom side. Also referring to FIG. 2, there is depicted an end view of the lower end of an exemplary bullnose corner member 10. As will be discussed below, the differences in the embodiments of FIGS. 1, 1A and 1B is in regards to the various perforations 60, 62, 64 that can be employed. The bullnose corner member 10, 10A, 10B comprises a generally planar right side flange section 20 and a generally planar left side flange section 40 with a raised bullnose arcuate edge 80 connected to the respective generally right side and left side flanges 20, 40 via respective generally planar bullnose right side lip (shoulder stop) 70 and generally planar bullnose left side lip (shoulder stop) 73.

The right side flange 20 is shown in a generally rectangular configuration having a right side flange outer edge 21 and a right side flange inner edge 22 opposite the right side flange outer edge 21.

The right side flange 20 also comprises a right side flange upper edge 23 extending between the right side flange outer edge 21 and the right side flange inner edge 22. The right side flange upper edge 23 intersects with the right side flange outer edge 21 at a right side flange upper edge outside end 24. The right side flange upper edge 23 also intersects with the right side flange inner edge 22 at a right side flange upper edge inside end 25.

The right side flange 20 also comprises a right side flange lower edge 26 extending between the right side flange outer edge 21 and the right side flange inner edge 22, and being opposite the right side flange upper edge 23. The right side flange lower edge 26 intersects with the right side flange outer edge 21 at a right side flange lower edge outside end 27. The right side flange lower edge 26 also intersects with the right side flange inner edge 22 at a right side flange lower edge inside end 28.

The right side flange 20 has a width 77 defined as, e.g., the distance between the right side flange upper edge outside end 24 and the right side flange upper edge inside end 25 or the distance between the right side flange inner edge 22 and right side flange outer edge 21. The right side flange 20 has a right side flange outer or top surface 29 forming a part of the bullnose corner member top side and a right side flange inner or underside surface 30 forming a part of the bullnose corner member bottom side.

Similarly, in what can be essentially a mirror image-like fashion to the right side flange 20, the left side flange 40 is shown in a generally rectangular configuration having a left side flange outer edge 41 and a left side flange inner edge 42 opposite the left side flange outer edge 41.

The left side flange 40 also comprises a left side flange upper edge 43 extending between the left side flange outer edge 41 and the left side flange inner edge 42. The left side flange upper edge 43 intersects with the left side flange outer edge 41 at a left side flange upper edge outside end 44. The left side flange upper edge 43 also intersects with the left side flange inner edge 42 at a left side flange upper edge inside end 45 (see FIG. 3).

The left side flange 40 also comprises a left side flange lower edge 46 extending between the left side flange outer edge 41 and the left side flange inner edge 42. The left side flange lower edge 46 intersects with the left side flange outer edge 41 at a left side flange lower edge outside end 47. The left side flange lower edge 46 also intersects with the left side flange inner edge 42 at a left side flange lower edge inside end 48.

The left side flange 40 has a width 79 defined as, e.g., the distance between the left side flange lower edge outside end 47 and the left side flange lower edge inside end 48 or the distance between the left side flange inner edge 42 and left side flange outer edge 41. The left side flange 40 has a left side flange outer or top surface 49 forming a part of the bullnose corner member top side and a left side flange inner or underside surface 50 forming a part of the bullnose corner member bottom side.

The bullnose arcuate edge section 80 is generally rectangular comprising a bullnose right edge 84 and a bullnose left edge 88 opposite thereto.

The bullnose arcuate edge section 80 also has a bullnose upper curved end 81 extending between the bullnose right edge 84 and the bullnose left edge 88. The bullnose upper curved end 81 intersects with the bullnose right edge 84 at a bullnose upper end right side corner 82. The bullnose upper curved end 81 intersects with the bullnose left edge 88 at a bullnose upper end left side corner 83 (hidden from view).

The bullnose arcuate edge 80 also has a bullnose lower curved end 85 (opposite the upper curved end 81) extending between the bullnose right edge 84 and the bullnose left edge 88. The bullnose lower curved end 85 intersects with the bullnose right edge 84 at a bullnose lower end right side corner 86. The bullnose lower curved end 85 intersects with the bullnose left edge 88 at a bullnose lower end left side corner 87.

The bullnose arcuate edge 80 also comprises a bullnose outer or top surface 89 which is generally convex and a bullnose inner or underside surface 90.

The bullnose arcuate edge 80 is connected or otherwise attached to the right side and left side flanges 20, 40 via respective bullnose right side lip (shoulder stop) 70 and bullnose left side lip (shoulder stop) 73.

The bullnose right side lip (shoulder stop) 70 is a generally rectangular planar member that extends between the right side flange inner edge 22 and the bullnose right edge 84. The bullnose right side lip left edge shares the same edge as the bullnose right edge 84. The bullnose right side lip right edge shares the same edge as the right side flange inner edge 22. The bullnose right side lip 70 top edge 91 extends between the right side flange upper edge inside end 25 and the bullnose upper end right side corner 82. The bullnose right side lip 70 bottom edge 92 extends between the right side flange lower edge inside end 28 and the bullnose lower end right side corner 86. The bullnose right side lip 70 has a bullnose right side lip outer or top surface 71 and a bullnose right side lip inner or underside surface 72. The bullnose right side lip 70 has a width 76 defined as the distance between the right side flange inner edge 22 and the bullnose right edge 84. The bullnose right side lip 70 meets the right side flange 20 at a desired right side lip/flange intersection angle 66.

Similarly, the bullnose left side lip (shoulder stop) 73 is a generally rectangular planar member that extends between the left side flange inner edge 42 and the bullnose left edge 88. The bullnose left side lip right edge shares the same edge as the bullnose left edge 88. The bullnose left side lip left edge shares the same edge as the left side flange inner edge 42. The bullnose left side lip 73 top edge 93 extends between the left side flange upper edge inside end 45 and the bullnose upper end left side corner 83 (see FIG. 3). The bullnose left side lip 73 bottom edge 94 extends between the left side flange lower edge inside end 48 and the bullnose lower end left side corner 87. The bullnose left side lip 73 has a bullnose left side lip outer or top surface 74 and a bullnose left side lip inner or underside surface 75. The bullnose left side lip 73 has a width 78 defined as the distance between the left side flange inner edge 42 and the bullnose left edge 88. The bullnose left side lip 73 meets the left side flange 40 at a desired left side lip/flange intersection angle 68.

Figure 2:
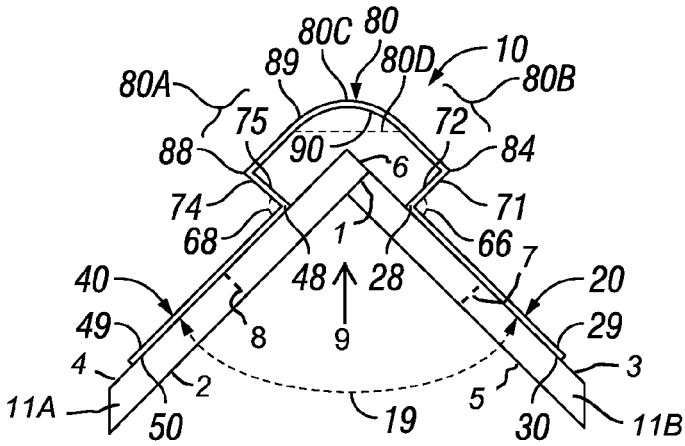
FIG. 2 illustrates an end view of an elongate bullnose corner member, such as depicted in FIG. 1, according to one embodiment of the present invention.
Figure 3:
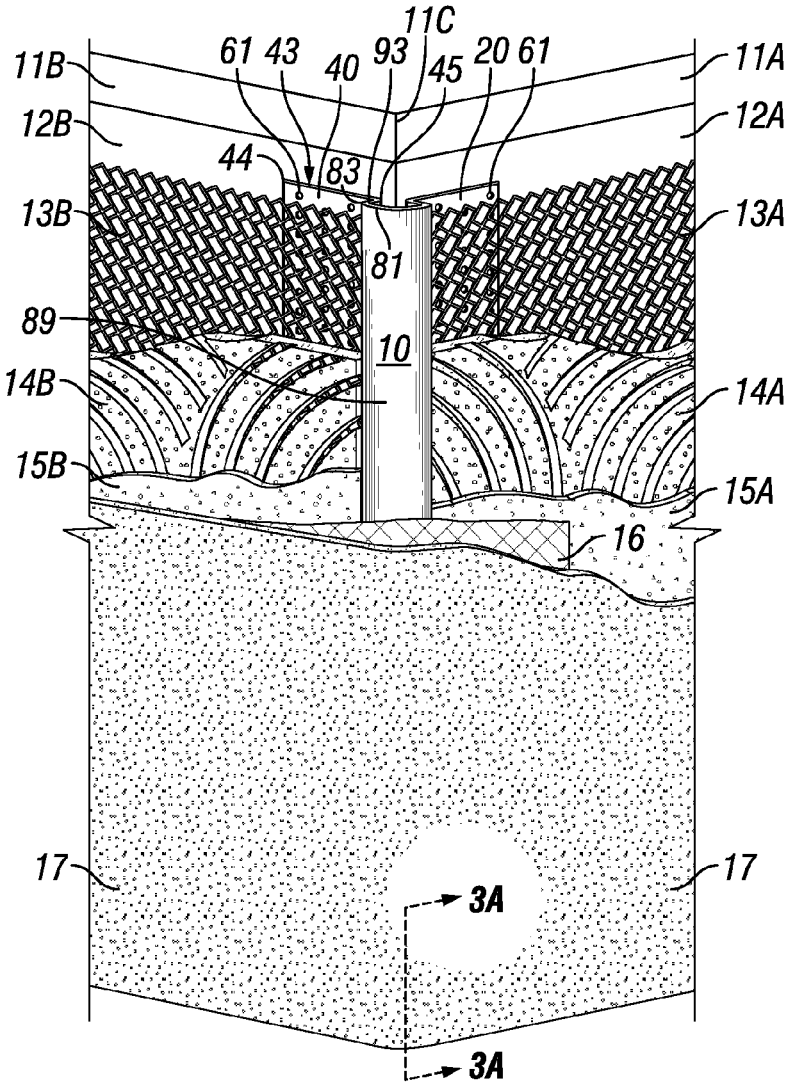
FIG. 3 illustrates a partial cut-away perspective view illustrating an elongate bullnose corner member, such as shown in FIG. 1, installed according the present invention.

The right side lip/flange intersection angle 66 and the left side lip/flange intersection angle 68 shown in, e.g., the embodiment depicted in FIG. 2, are both illustrated as being 90 degrees. However, these lip/flange intersection angles 66, 68 could vary, for example and without limitation, between about 45 degrees and 135 degrees—i.e., acute (see, e.g., FIG. 4E, angles 66*e*, 68*e*) to obtuse (see, e.g., FIG. 4F, angles 66*f*, 68*f*). Where these lip/flange intersection angles are less than 90 degrees (acute), the lip outer faces 71, 74 will assist in holding in place the stucco or other cement/plastering layer(s) (e.g., 14*a*, 15*a* shown in FIG. 3) applied to the flange outer surfaces 29, 49 by trapping part of the stucco or other plastering layer underneath the overhang of the lips 70, 73. Furthermore, the lip structures could be modified to better hold or retain stucco, such as by creating the lips as concave surfaces 70*d*, 73*d* as illustrated in FIG. 4D, creating a V-shaped troughs 70*g*, 73*g*, in the lip structure as illustrated in FIG. 4G, creating divots/dimples (not shown) on the surface, creating corrugations on the surface (not shown), roughening the surface (e.g., sanding, etching lines or striations, etc.) and other suitable techniques or modifications.

Figure 4A:
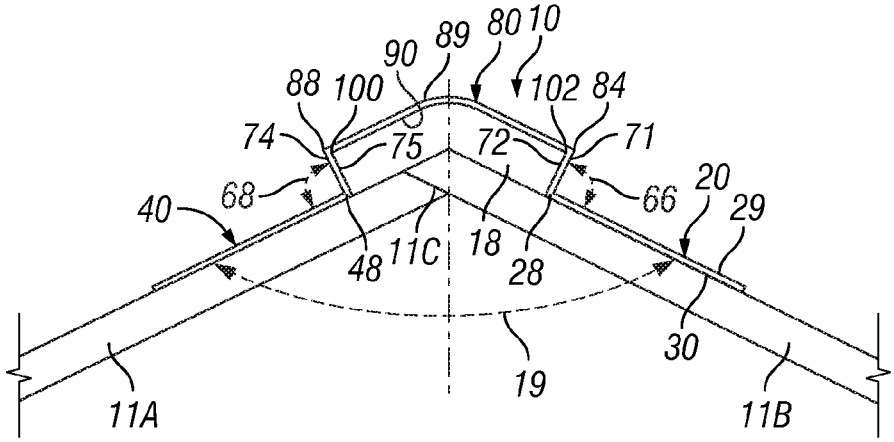
FIG. 4A illustrates an end view of an elongate bullnose corner member, such as depicted in FIG. 1, installed over obtuse-angled adjacent corner surfaces according to one embodiment of the present invention.
Figure 4B:
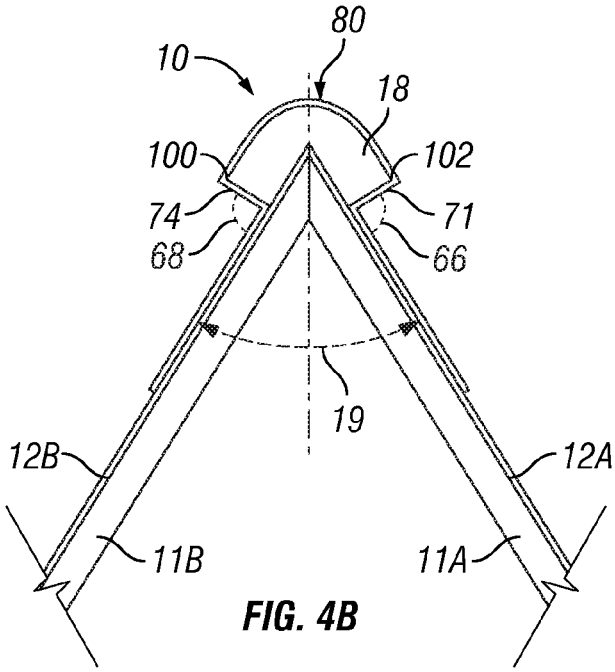
FIG. 4B illustrates an end view of an elongate bullnose corner member, such as depicted in FIG. 1, installed over acute-angled adjacent corner surfaces according to one embodiment of the present invention.
Figure 4C:
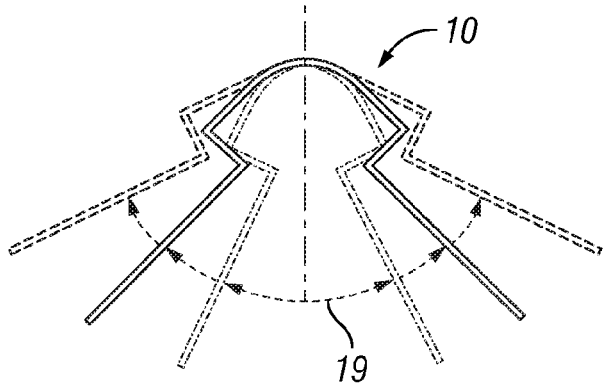
FIG. 4C illustrates an end view of an elongate bullnose corner member, such as depicted in FIG. 1, showing the various obtuse, right, and acute angle corner configurations.
Figure 4D:
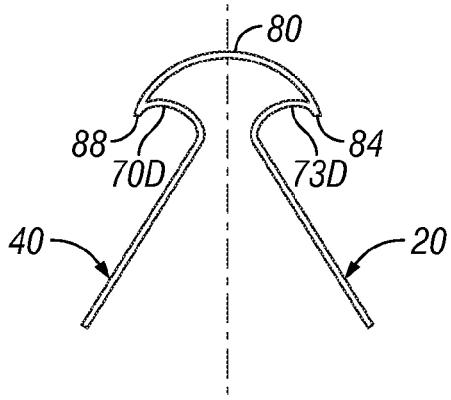
FIG. 4D illustrates an end view of an elongate bullnose corner member having a concave curved lip structure.
Figure 4G:
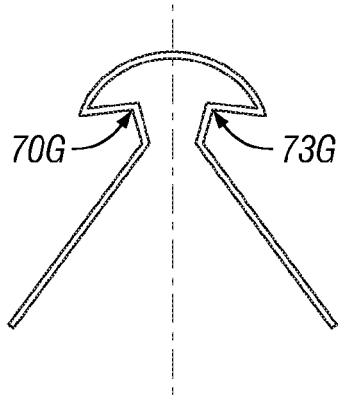
FIG. 4G illustrates an end view of an elongate bullnose corner member having a V-shaped trough-like lip structure.
Figure 4E:
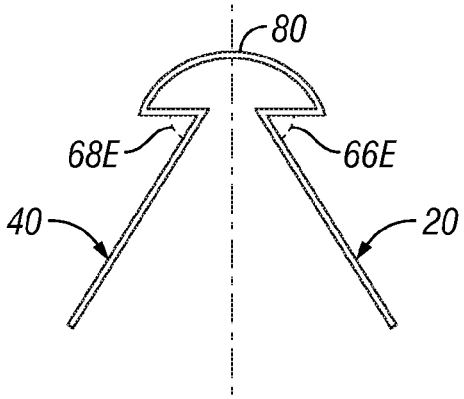
FIG. 4E illustrates an end view of an elongate bullnose corner member having a lip/flange angle that is acute.
Figure 4F:
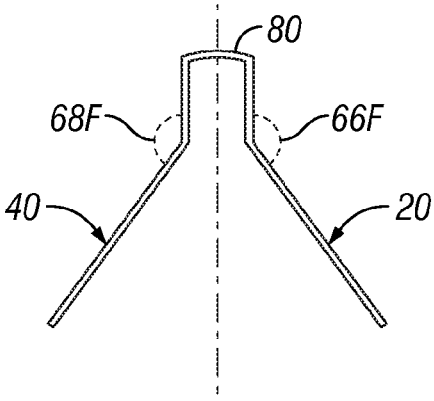
FIG. 4F illustrates an end view of an elongate bullnose corner member having a lip/flange angle that is obtuse.

Referring also to FIGS. 4A and 4B, for example, the bullnose corner member 10 can be further defined to include a bullnose top right side shoulder stop/bullnose right edge inside intersection angle 100 (i.e., the inside angle formed between edge 84 and shoulder stop inner surface 72) and a bullnose top left side shoulder stop/bullnose left edge inside intersection angle 102 (i.e., the inside angle formed between edge 88 and shoulder stop inner surface 73). When installed over the abutting wall member corner, a bullnose interior space 18 is formed.

Referring now to FIGS. 2, 4A, 4B and 4C, the bullnose corner member 10 is capable of adapting to a varying range of flange angles 19—i.e., the angle between the right side flange inner surface 30 and the left side flange inner surface 50 during installation to accommodate the angle created by the intersection of the two adjacent wall surfaces (e.g., 11*a*, 11*b*) receiving the bullnose corner member 10. For example, the bullnose corner member 10 can be constructed having an initial flange angle 19 of 90 degrees to accommodate a standard 90 degree corner, but where needed, the same prefabricated bullnose corner 10 having a 90 degree flange angle 19 could also be installed on corners ranging from, e.g., about 60 degrees to about 120 degrees or other desired flange angle 19. Also, the bullnose corner member 10 of the present invention could also be pre-made having the desired flange angle 19. This adjustability of the flange angle 19 (and hence the length of chord 80*d*) permits the bullnose corner to accommodate varying bullnose radiuses or corner curvatures.

Referring to FIG. 1, in one embodiment, the left side flange 40 and/or the right side flange 20 may be outfitted with one or more flange perforations 60 to serve as pre-drilled (or laser cut, etc. as the case may be) holes for receiving nails or screws (or other suitable fasteners) used to attach the bullnose corner member 10, 10A, 10B to the underlying structure and/or to create irregularities in the flange outer surfaces 29 and/or 49 to facilitate adherence of the stucco or other plastering layer 14*a* that is later applied (see also FIGS. 3, 3A, 3B, 3C discussed further below). Although the flange perforations 60 are shown in a generally diagonal pattern, other patterns could be employed, such as for example, a centered five hole pattern, straight rows, or the like.

In an alternate embodiment, the left side flange 40 and the right side flange 20 are not outfitted with any perforations, but instead, the nails or screws themselves perforate the flanges 20, 40 of the bullnose corner member 10, 10A, 10B when it is being attached to the underlying structure. In another alternate embodiment, the flange outer surfaces 29, 49 are scratched, divoted or otherwise roughened to create irregularities to facilitate adherence of the stucco layer 14*a* that is later applied. In another embodiment, the flanges 20, 40 comprise an expanded mesh lath surfaces.

As will be appreciated from the present disclosure, the bullnose left side flange width 79 and the bullnose right side flange width can be of equal widths; however, custom sizes and designs are possible where the left and right flanges might have different widths. In one embodiment, the bullnose left side flange width 79 and the bullnose right side flange width 77 are both 3 inches wide. One of the purposes of the right side flange 20 and the left side flange 40 is to provide a surface for securing the bullnose corner member 10 onto a desired underlying structure, such as an exposed corner of a house or other building that will be receiving a stucco or plastering type finish.

The bullnose corner members 10, 10A, 10B can be made out of a variety of materials, including, for example and without limitation, various metals, plastics, vinyls and elastomeric compounds. In one embodiment, the bullnose corner member 10 is constructed of a solid metal material. In another alternate embodiment, the bullnose corner member 10 is constructed of a plastic material such as cpvc or other plastic. In yet another embodiment, the bullnose corner member 10 is made from a vinyl material. Many other suitable materials exist in the art for constructing the bullnose corner member 10, including metals, alloys such as titanium, zinc and aluminum alloys, HST aluminum, 431 stainless steel, 17-4 stainless steel, Ti-alloy, galvanized steel, maraging metal, bi-metal, tungsten insert, plastics, injection molded plastics, ceramics, graphite, boron, KEVLAR® material and other synthetic materials, carbon fiber, resin, fiberglass, composites, wood, laminated wood, and compositions thereof. Where the bullnose corner member will be used beneath a stucco finish, if the bullnose corner member 10 is made from a metal material, then preferably the metal material will be aluminum or other non-rusting alloy or composite. Additionally, if desired, the bullnose corner member material could be coated with a water and corrosion resistant surface coating material, such as, for example and without limitation, paint, lacquer, varnish, plastic and the like.

Where the bullnose corner member 10 is constructed out of a metal material, it can be prepared in varying desired lengths (e.g., 8', 10', 12', etc.) for example by taking a flat stock material and forming it with standard tool and die techniques such as stamping, crimping, etc. so that the bullnose corner member 10 is made of a unitary construction (out of one piece). Additionally, varying custom lengths of the bullnose corner member 10 could be constructed on site or elsewhere by roll forming the flat stock metal in a custom die, much like the technique presently known in the art and used to manufacture custom length rain gutters at a job site by roll forming a desired length from a spool of flat stock material (e.g., aluminum). When roll forming techniques are used to construct the bullnose corner member 10, custom lengths can be created to permit a continuous length of bullnose corner member to be used to cover the entire length of the desired corner. The bullnose corner member 10 could also be formed from an extruded material via extrusion techniques and the like using materials suitable for such extrusion manufacturing technique.

However, it is clear from the disclosure herein that, e.g., a separate flange member (e.g., 20) could be attached to a separate lip/stop member (e.g., 70) by e.g., welding the two adjoining edges together or using other attachment methods known in the art. The other edge of the lip could then be attached to the adjoining edge of the bullnose arcuate edge, etc.

When shorter lengths of the bullnose corner member 10 are employed along the length of a corner structure, the lower end 85 of one bullnose corner member 10 can be butted up against the upper end 81 of an adjacent installed bullnose corner member 10. If desired, a fiberglass tape or other type of tape could be used to cover the seam between abutted ends of adjacent bullnose corner members 10.

Figure 3A:
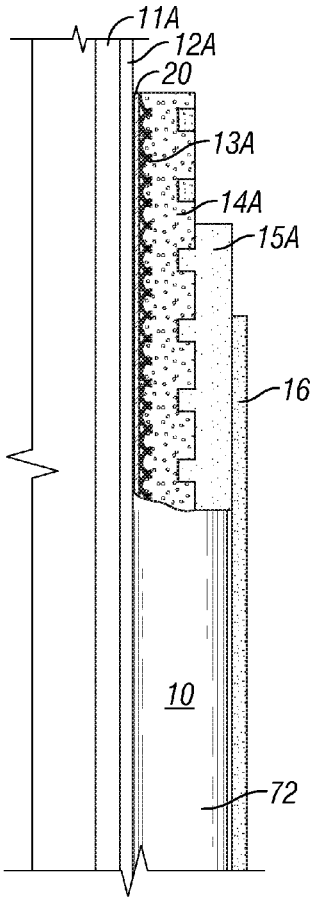
FIG. 3A illustrates a partial cut-away sectional view taken along lines 3A-3A of FIG. 3 illustrating an elongate bullnose corner member of FIG. 1 installed according the present invention.
Figure 3B:
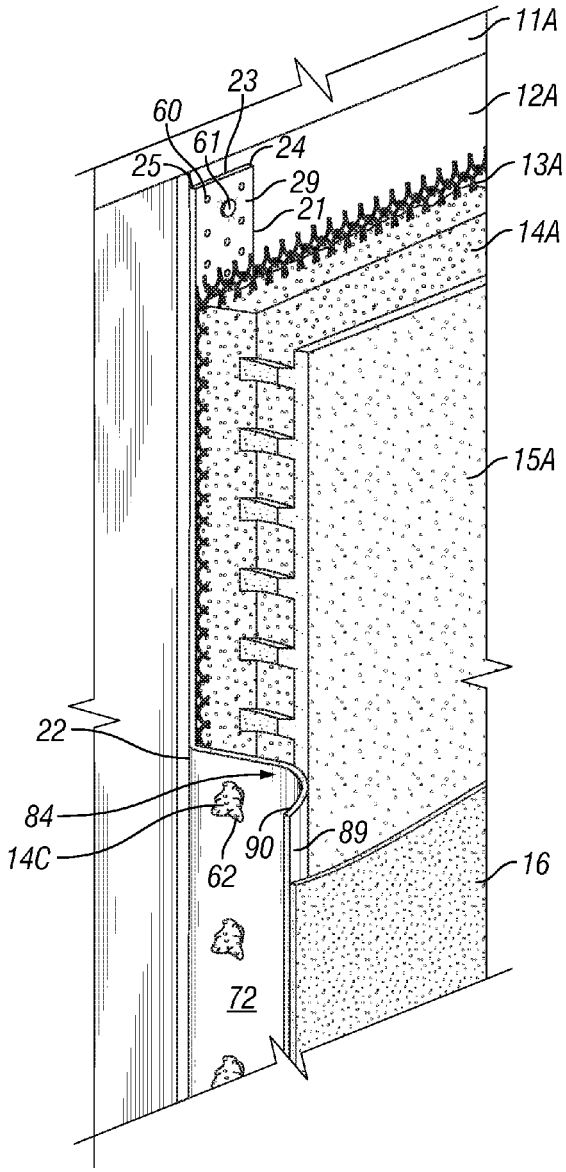
FIG. 3B illustrates a partial cut-away sectional perspective view taken along lines 3A-3A of FIG. 3 illustrating an elongate bullnose corner member of FIG. 1A installed according the present invention.

Referring now to FIG. 1A and FIG. 3B, there is shown an embodiment of a bullnose corner member 10A employing one or more lip perforations 62. The bullnose right side lip (shoulder stop) 70 and bullnose left side lip (shoulder stop) 73 may be outfitted with one or more lip perforations 62. The primary purpose for the one or more lip perforations 62 would be to permit some of the underlying stucco or other plastering material 14*c* to ooze through the lip perforations to the bullnose lip inner surfaces 72, 75 to help secure the underlying stucco or other plastering material to the lips 70, 73. Although the lip perforations 62 are displayed in a linear spaced-apart fashion down the centerline of the lips 70, 73, other configurations could be employed (such as, for example and without limitation, the configuration shown in FIG. 1B).

In one embodiment, the bullnose left side flange width 79 and the bullnose right side flange width 77 are both about 3 inches wide; on a 8 foot length of bullnose corner member 10, the lip perforations 62 are ⅜ inch diameter holes spaced about 4 to 6 inches apart; the bullnose left side lip width 76 and the bullnose right side lip width 78 are both about 0.75 inches.

Figure 3C:
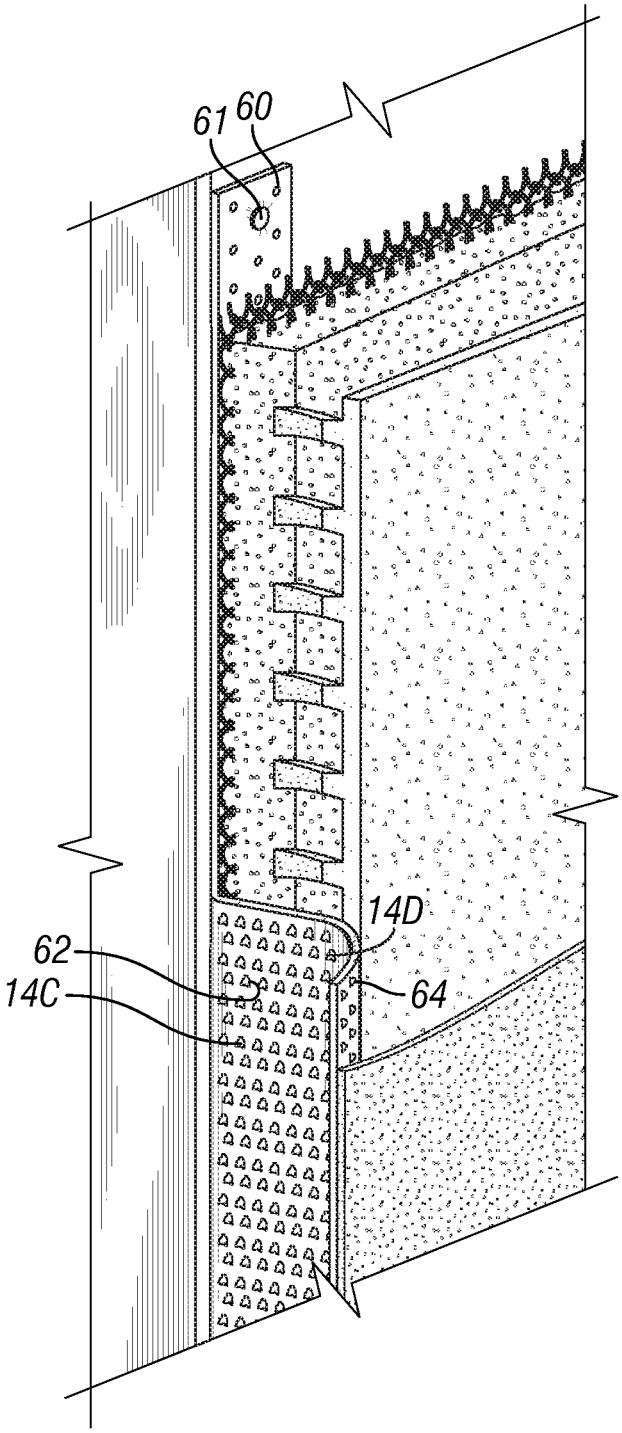
FIG. 3C illustrates a partial cut-away sectional perspective view taken along lines 3A-3A of FIG. 3 illustrating an elongate bullnose corner member of FIG. 1B installed according the present invention.

Referring now to FIG. 1B and FIG. 3C, there is shown an embodiment of a bullnose corner member 10B employing one or more bullnose edge perforations 64. The bullnose arcuate edge 80 may be outfitted with one or more bullnose edge perforations 64 to serve to permit some of the stucco or other plastering material (or finishing layers) 14*d* to ooze through the perforations 64 onto the bullnose inner surface 90 and assist in locking down the plastering material to the bullnose outer surface 89. The bullnose edge perforations 64 can be arranged in any desired pattern, such as in rows as generally shown in FIG. 1B. Although FIGS. 1B and 3C show perforations 60, 62, 64 over the entire surface of the bullnose corner member 10, the location of perforations can be varied and in any combination, such as, for example, just on the bullnose lips 70, 73, just on the bullnose arcuate edge 80 or on the lips 70, 73 and arcuate edge 80.

Figure 5A:
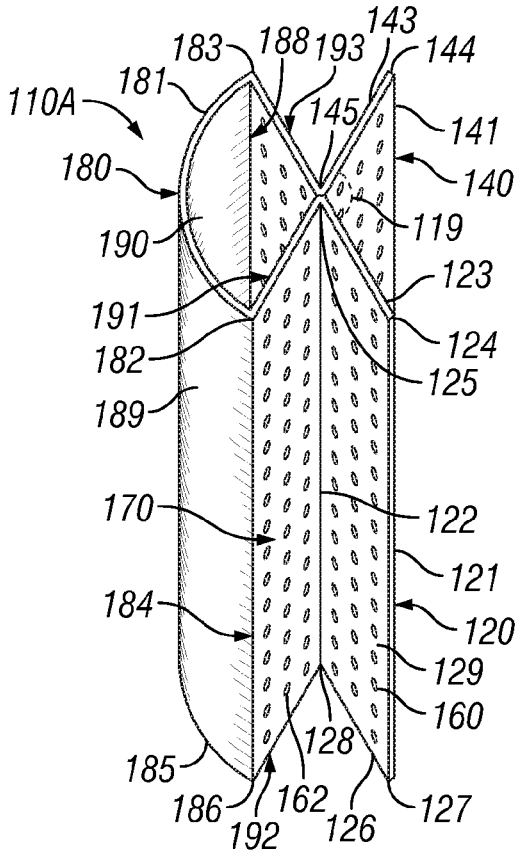
FIG. 5A illustrates a right side perspective view of another embodiment of an elongate bullnose corner member according the present invention.
Figure 5B:
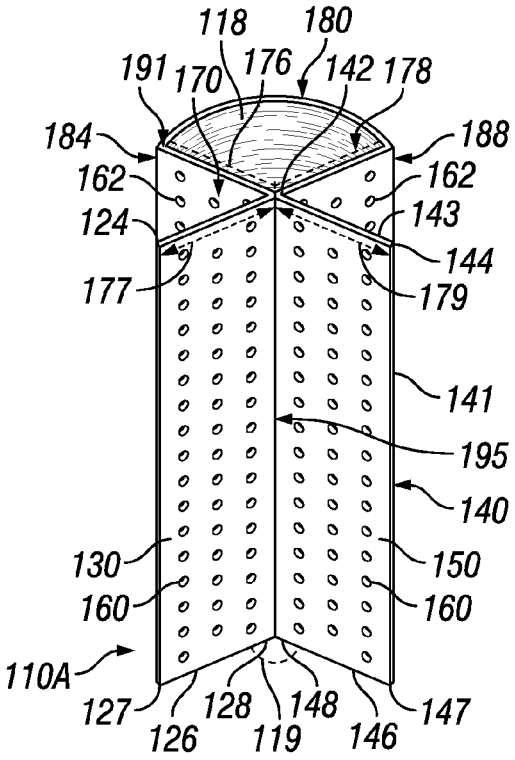
FIG. 5B illustrates an underside perspective view of the elongate bullnose corner member shown in FIG. 5A.
Figure 5C:
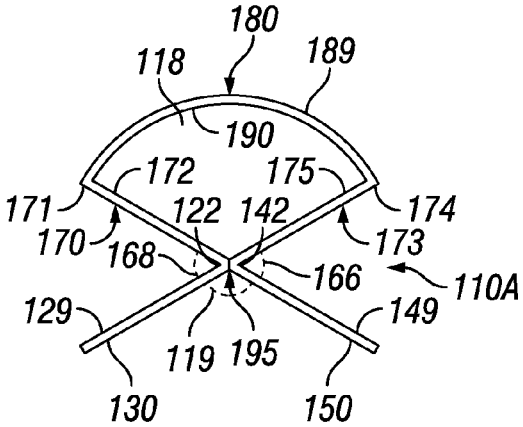
FIG. 5C illustrates an end view of the elongate bullnose corner member depicted in FIGS. 5A and 5B.

Referring now to FIGS. 5A, 5B and 5C, there is depicted another embodiment of a bullnose corner member 110A similar in most respects to the embodiments described above in connection with FIGS. 1, 1A and 1B with the difference in the embodiment of FIGS. 5A, 5B and 5C being that the right and left flange inner edges 122, 142 are joined together to form a flange/lip intersection seam 195. This intersection seam 195 can be created by welding, spot welding or otherwise fixedly attaching the flange inner edges 122, 142 together using standard techniques including where the corner member 110A is molded or extruded as a unitary piece. The element numbering system employed with FIGS. 5A, 5B and 5C is the same as with, e.g., FIGS. 1, 1A and 1B except that they are in the 100 series of numbering, e.g., the bullnose corner member 10A of FIG. 1A is referred to in FIG. 5A as bullnose corner member 110A, right flange 20 of FIG. 1 is labeled 120 in FIG. 5A, etc. All of the teachings and features of the embodiments shown in FIGS. 1, 1A, 1B and 2 are applicable to the embodiment of FIGS. 5A, 5B and 5C. For example, the embodiment of FIGS. 5A, 5B and 5C can employ the variety of perforations 60 (160), 62 and/or 64 discussed in connection with, e.g., FIGS. 1, 1A, 1B. Furthermore, the embodiment of FIGS. 5A, 5B, and 5C can be constructed out of the same material and in the same manner as with the embodiments discussed earlier. For example, this embodiment can be extruded as a unitary piece, or stamped or rolled much like with the FIG. 1 embodiment with the last step being to attach the two flange inner edges 122, 142 parts or all of flange/lip intersection seam 195. Additionally, in this embodiment, the lip lengths 176, 178, the flange widths 177, 179, the lip/flange intersection angles 166, 168 and the flange angle 119 can all be varied to create the bullnose corner member 110A that is of the desired dimensions. Although the embodiment shown in FIGS. 5A, 5B and 5C depicts the seam 195 in a vertical orientation, as if for example, the flanges 20, 40 of FIG. 1A were pinched together until their respective inner edges (22, 42 shown in FIG. 1) touch and are then attached together, the seam 195 could be horizontal as if an L-shaped elongate flange member (see FIG. 6 discussed below) is attached to a teardrop or pie-shaped or quarter round-shaped section (the term quarter round-shaped section not being intended to limit the intersection angle to 90 degrees). Also, the configuration shown in FIGS. 5A, 5B and 5C could also be achieved in other ways, such as by welding or otherwise attaching the various components (flanges, lips, arcuate edges) together.

In another variation of the embodiment shown in FIGS. 5A, 5B and 5C, the bullnose corner member 110 could be formed as shown but without actually attaching the right and left flange inner edges 122, 142 together.

In another embodiment of the present invention, there is disclosed and described an adjustable radius bullnose corner member 10, 110 having an architecturally radiused curvature 80, 180 along the length of its outer surface for mounting over and strengthening the structural integrity of two adjacent corner wall members (e.g., 11*a*, 11*b*) of a structure and for receiving on its outer surface a wall plastering material such as stucco or the like (e.g., 14, 15, 16) used to finish the corner to match the finish of the two adjacent wall members. In this embodiment, the bullnose corner member comprises a radiused bullnose arcuate outer surface running the length of the bullnose corner member, the bullnose arcuate outer surface 89, 189 having two opposed parallel right and left side edges (84, 88; 184, 188), a central curved section 80*c* (see FIG. 2) flanked by two linear left and right planar sections (80*a*, 80*b*) extending to the left and right side bullnose arcuate outer surface edges 84, 88, respectively, the central curved section 80*c* having left and right endpoints, the distance between such endpoints defining a chord 80*d* (see FIG. 2) having a chord length, the central curved section 80*c* being flexible to permit adjusting the length of the chord 80*d* during installation of the bullnose corner member 10 over the two adjacent corners.

In this embodiment, the adjustable radius bullnose corner member further comprises a substantially rectangular right side shoulder stop 70 having two opposed parallel top and bottom right side shoulder stop edges, the top right side shoulder edge attached to and extending downwardly from the bullnose arcuate outer surface right side edge 84 at a bullnose top right side shoulder stop/bullnose right edge inside intersection angle 102 ranging between about 135 degrees and about 45 degrees, and a substantially rectangular left side shoulder stop having two opposed parallel top and bottom left side shoulder stop edges, the top left side shoulder edge attached to and extending downwardly from the bullnose arcuate outer surface left side edge 88 at a bullnose top left side shoulder stop/bullnose left edge inside intersection angle 100 ranging between about 135 degrees and about 45 degrees.

The bullnose corner member of this embodiment also has a substantially rectangular right side attachment flange 20 having two opposed parallel inside and outside right side flange edges (22, 21), the inside right side flange edge 22 attached to and extending outwardly from the bottom right side shoulder stop edge at a right side shoulder/flange intersection angle 66 ranging between about 45 degrees and about 135 degrees, and a substantially rectangular left side attachment flange 40 having two opposed parallel inside and outside left side flange edges 42, 41, the inside left side flange edge 42 attached to and extending outwardly from the bottom left side shoulder stop edge at a left side shoulder/flange intersection angle 68 ranging between about 45 degrees and about 135 degrees. The bullnose top right side shoulder stop/bullnose right edge inside intersection angle 102 and the right side shoulder/flange intersection angle 66 add up to be about 180 degrees, the bullnose top left side shoulder stop/bullnose left edge inside intersection angle 100 and the left side shoulder/flange intersection angle 68 add up to be about 180 degrees. The bullnose outer surface left and right planar sections 80*a*, 80*b* are substantially parallel to the respective left and right flanges 20, 40 when the bullnose corner member 10 is mounted over the two adjacent wall members.

In another embodiment of the adjustable radius bullnose corner member, the bullnose top right side shoulder stop/bullnose right edge inside intersection angle 102 is about 90 degrees, the bullnose top left side shoulder stop/bullnose left edge inside intersection angle 100 is about 90 degrees, the right side shoulder/flange intersection angle 66 is about 90 degrees, and the left side shoulder/flange intersection angle 68 is about 90 degrees.

Referring now to FIGS. 3 and 3A, there is depicted in partial cutaway view a bullnose corner member 10 installed on a structural corner, such as a wood framed structure, a cinder block structure, a metal frame structure or the like. For example, and without limitation, a typical installation of a bullnose corner member 10 of the present invention over a wood frame would proceed as follows. With a standard wood frame construction, typically the outer framework (not shown) will first be covered with a layer of structural plywood or other wall covering structural material/sheathing 11*a*, 11*b*. For example, and in reference also to FIG. 2, two plywood panels 11*a*, 11*b* would abut in overlapping fashion against each other in the corner to form an intersection 11*c* of the two panels such that the butt end 1 of one panel 11*b* is covered by the inside face 2 of the adjacent panel 11*a* to create a continuous corner such as that depicted in FIGS. 2, 3, 4A and 4B. The abutting wall members 11*a*, 11*b*, each respectively comprise an outer face 3, 4, an inner face 2, 5, opposed top and bottom edges (not shown) and opposed side edges (e.g., 1, 6), the edges forming a wall member thickness 7, 8 between said outer and inner wall member faces (3, 5), (4, 2), wherein one of the opposed side edges 1 of the first wall member 11*b* abuts up against the inner face 2 of the second wall member 11*a* adjacent the side edge 6 of the second wall member 11*a*. The adjacent side edge 6 of the second wall member is aligned to be flush with the outer face 3 of the adjacent first wall member 11*b* to form forming a corner edge 9. One or more waterproofing layers or weather resistant barriers 12*a*, 12*b*, such as the Dupont TYVEK® brand weather barriers (including stucco wrap), and/or a felt (tar/bitumen) building paper or the like would typically next be placed over the plywood. The bullnose corner member 10 would then be secured to the corner structure by attaching its right side flange 20 and left side flange 40 to the underlying structure with suitable fasteners, such as a nails or screws 61 (alternatively, glue could be used but would not be as preferred as nails or screws). In one embodiment, the bullnose corner member 10 is made in or cut to a custom length to fit substantially the entire length of the corner structure. In another embodiment, more than one bullnose corner member 10 is employed to cover the length of a desired corner structure, in which case, the bullnose corner members are preferably abutted together in an end-to-end fashion, where preferably, the abutted seams (not shown) created between the abutted ends of adjacent bullnose corner members are sealed using sealant, tape, fiberglass tape or the like. Securing the bullnose corner member(s) 10 in place serves also to tie together the adjacent edges of structural panels 11*a*, 11*b* thereby strengthening the structural integrity of the corner.

Once the bullnose corner members 10 are fixed in place to the underlying corner structure, the remainder of the stucco or plastering application (using traditional or synthetic stucco materials) follows standard practices. For example, a wire mesh material 13*a*, 13*b*, such as diamond pattern metal lath material or expanded mesh material, is attached over the walls and over the right side flange 20 and left side flange 40 outer surfaces 29, 49, respectively of each bullnose corner member 10, preferably up to the lips 70, 73 (the flange inner edges 22, 42. However, if a lath layer has already been applied to the structure prior to installing the bullnose corner members 10, then the bullnose corner members 10 could be installed over the top of the lath layer, in which case, it would still be preferable to then add a layer of lath over the flanges 20, 40. A first coat (also called a scratch coat) of stucco or other plastering material 14*a*, 14*b* (e.g., typically a cement and sand mixture) is applied over the lath layer 13*a*, 13*b*. The scratch coat layer is applied so that it abuts up to the lips 70, 73 (the flange inner edges 22, 42). Next, a leveling coat (also called a brown coat) of stucco or other plastering material 15*a*, 15*b* is applied over the scratch coat layer 14*a*, 14*b*. Preferably, this leveling coat layer 15*a*, 15*b* abuts up against the lips 70, 73 and is leveled out to be flush with the bullnose right and left edges 83, 88 (i.e., to cover any remaining lip outer surfaces 71, 74). Typically, a final layer coat 17, such as an acrylic or elastomeric stucco or plaster finish product will be applied over the leveling coat 15*a*, 15*b* and over the bullnose edge outer surface 89. As installed, the outward appearance of the bullnose corner will be smooth and seamless and remain less vulnerable to chipping and denting.

In another embodiment of the present invention, after the installation of the bullnose corner, and after the leveling coat layer 15*a*, 15*b* is put in place, a layer of fiberglass mesh (or other suitable cloth-like structural mesh material) 16 can be installed over the bullnose corner member prior to application of the final layer coat 17. Ideally, the fiberglass mesh layer 16 would be of sufficient width to extend over the bullnose left and right edges 88, 84. Preferably, the mesh layer 16 would be of sufficient width to extend beyond the left and right side flange outer edges 41, 21. For example, the mesh layer could extend beyond the bullnose left and right edges 88, 84 by a distance of about one to two flange widths 77, 79. The fiberglass or cloth-like structural mesh layer is installed using standard techniques, such as by applying it with a thin layer of stucco or other plastering material.

Additionally, having a bullnose corner member 10 so installed will add to the strength of the corner by tying together the underlying adjacent wall panels 11*a*, 11*b* in the corner, and by also adding additional ties between the overlapping top plate in the corner. This bracing functionality adds to the structural integrity of the corner, and thereby increases the structural corner's resistance to the stress and load of wind forces that could cause damage. For optimal strengthening of the corners, the bullnose corner member is constructed of a metal material such as aluminum.

Figure 6:
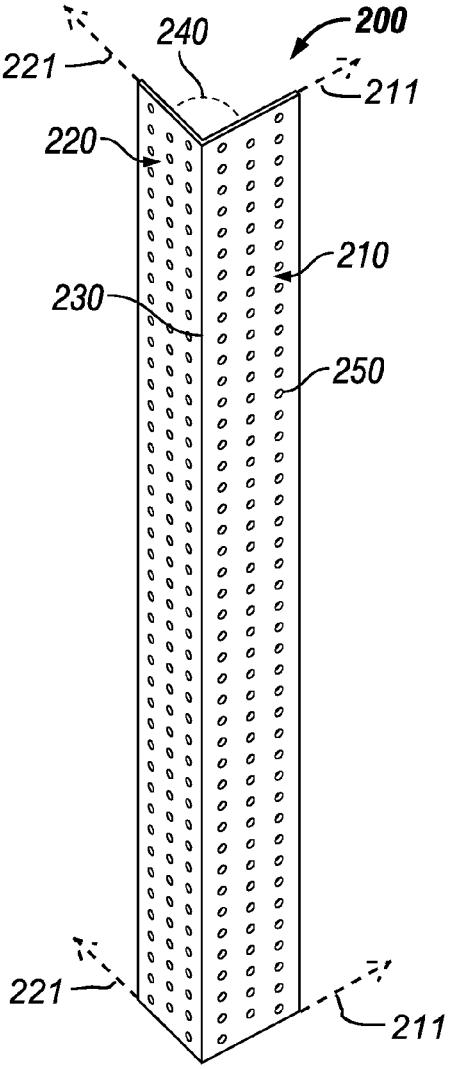
FIG. 6 illustrates an L-shaped corner structural member according to the present invention.

Referring now to FIG. 6, where a bullnose corner is not desired or is otherwise not called for, such as, for example, where the exterior finish will be brick or a wooden or vinyl/aluminum siding, or where the corner will not employ a bullnose feature, an angular, L-shaped corner structural member 200 can be employed. The L-shaped corner structural member 200 can be similar to the bullnose corner member 10 except that it does not employ the raised bullnose features (arcuate edge 80 and shoulders 70, 73). The L-shaped corner structural member 200 comprises two elongate, planar flange sections 210, 220 joined lengthwise along a corner seam 230. The angle 240 created between right and left flanges 210, 220 can vary like the flange angle 19 of the bullnose corner member 10, i.e., from obtuse to right to acute, including ranging from, e.g., about 60 degrees to about 120 degrees or other desired flange angle. When employed, the L-shaped corner structural member 200 will provide increased strength to the corner, much like described for the bullnose corner member 10. The L-shaped corner structural member 200 can be made by welding both planar flanges together at seam 230, or by pressing, stamping, molding, extrusion, etc. (such as by the techniques described above with respect to the bullnose corner member 10) to manufacture the L-shaped corner structural member 200 as a single unitary piece. Referring to FIG. 6, the outer surfaces or faces of structural member 200 are flat, and the corner structural member 200 does not form a bullnose corner. Planar flange 210 extends away from the seam 230 along a first plane 211. Planar flange 220 extends away from the seam 230 along a second plane 221. Corner seam 230 does not extend outside of either the first plane or the second plane. Much like with the onsite production of custom length rain gutters, the L-shaped corner structural member 200 can likewise be manufactured in custom lengths onsite or in predetermined lengths that can be installed and if necessary, cut to the desired length. The L-shaped corner structural member 200 can also employ, if desired, a pattern of nailing holes 250. The L-shaped corner structural member 200 can also be made of suitable materials such as those described above in connection with the bullnose corner member 10.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention may be utilized independently of the use of other features, all as would be apparent to one skilled in the art after having the benefit of this description of the invention. Further modifications and alternative embodiments of this invention will be apparent to those skilled in the art in view of this specification.

I claim:

1. A flexible, metal elongate bullnose corner member for attaching to and covering an external, continuous corner intersection of first and second adjacent, abutting exterior wall members of a structure that will receive a stucco finish of a desired thickness, the abutting wall members each comprising an outer face, an inner face, opposed top and bottom edges and opposed side edges, said edges forming a wall member thickness between said outer and inner wall member faces, wherein one of said opposed side edges of said first wall member abuts up against the inner face of said second wall member adjacent one of said opposed side edges of said second wall member, said adjacent side edge of said second wall member being aligned to be flush with said outer face of said adjacent first wall member to form a corner edge, the bullnose corner member comprising:

a. a top side, b. a bottom side, c. a right side flange having a right side flange outer edge and a right side flange inner edge opposite the right side flange outer edge, a right side flange upper edge extending between the right side flange outer edge and the right side flange inner edge, the right side flange upper edge intersecting with the right side flange outer edge at a right side flange upper edge outside end, the right side flange upper edge also intersecting with the right side flange inner edge at a right side flange upper edge inside end, a right side flange lower edge extending between the right side flange outer edge and the right side flange inner edge, and being opposite the right side flange upper edge, the right side flange lower edge intersecting with the right side flange outer edge at a right side flange lower edge outside end, the right side flange lower edge also intersecting with the right side flange inner edge at a right side flange lower edge inside end, a width defined as the distance between the right side flange inner edge and the right side flange outer edge, a right side flange outer surface forming part of the bullnose corner member top side and a right side flange inner surface forming a part of the bullnose corner member bottom side, said right side flange inner surface being attachable with suitable fasteners to one of said two exterior wall members, said right side flange outer surface being capable of receiving said stucco finish after being fastened to said wall member, d. a left side flange having a left side flange outer edge and a left side flange inner edge opposite the left side flange outer edge, a left side flange upper edge extending between the left side flange outer edge and the left side flange inner edge, the left side flange upper edge intersecting with the left side flange outer edge at a left side flange upper edge outside end, the left side flange upper edge also intersecting with the left side flange inner edge at a left side flange upper edge inside end, a left side flange lower edge extending between the left side flange outer edge and the left side flange inner edge, and being opposite the left side flange upper edge, the left side flange lower edge intersecting with the left side flange outer edge at a left side flange lower edge outside end, the left side flange lower edge also intersecting with the left side flange inner edge at a left side flange lower edge inside end, a width defined as the distance between the left side flange inner edge and the left side flange outer edge, a left side flange outer surface forming a part of the bullnose corner member top side and a left side flange inner surface forming a part of the bullnose corner member bottom side, said left side flange inner surface being attachable with suitable fasteners to the other of said two exterior wall members, said left side flange outer surface being capable of receiving said stucco finish after being fastened to said wall member, e. a generally rectangular bullnose arcuate edge section having a bullnose right edge and a bullnose left edge opposite thereto, a bullnose upper curved end extending between the bullnose right edge and the bullnose left edge, the bullnose upper curved end intersecting with the bullnose right edge at a bullnose upper end right side corner, the bullnose upper curved end intersecting with the bullnose left edge at a bullnose upper end left side corner, a bullnose lower curved end opposite the upper curved end extending between the bullnose right edge and the bullnose left edge, the bullnose lower curved end intersecting with the bullnose right edge at a bullnose lower end right side corner, the bullnose lower curved end intersecting with the bullnose left edge at a bullnose lower end left side corner, a convex-shaped bullnose outer surface capable of receiving said stucco finish, and a bullnose inner surface, f. a generally rectangular bullnose right side lip extending between the right side flange inner edge and the bullnose right edge, the bullnose right side lip left edge sharing the same edge as the bullnose right edge, the bullnose right side lip right edge sharing the same edge as the right side flange inner edge, a bullnose right side lip top edge extending between the right side flange upper edge inside end and the bullnose upper end right side corner, a bullnose right side lip bottom edge extending between the right side flange lower edge inside end and the bullnose lower end right side corner, a bullnose right side lip top surface capable of receiving said stucco finish and a bullnose right side underside surface, a width defined as the distance between the right side flange inner edge and the bullnose right edge, the bullnose right side lip meeting the right side flange at a desired right side lip/flange intersection angle, and g. a generally rectangular bullnose left side lip extending between the left side flange inner edge and the bullnose left edge, the bullnose left side lip right edge sharing the same edge as the bullnose left edge, the bullnose left side lip left edge sharing the same edge as the left side flange inner edge, a bullnose left side lip top edge extending between the left side flange upper edge inside end and the bullnose upper end left side corner, a bullnose left side lip bottom edge extending between the left side flange lower edge inside end and the bullnose lower end left side corner, a bullnose left side lip top surface capable of receiving said stucco finish and a bullnose left side underside surface, a width defined as the distance between the left side flange inner edge and the bullnose left edge, the bullnose left side lip meeting the left side flange at a desired left side lip/flange intersection angle, and h. an adjustable bullnose flange angle defined as the angle between the right side flange inner surface and the left side flange inner surface, said right side lip width and said left side lip width being sufficiently wide enough to permit the bullnose corner member to be placed over said adjacent, abutting wall members such that there remains sufficient space for the corner edge of the abutting wall members to reside proximate said bullnose inner surface.

2. The bullnose corner member of claim 1 wherein the left and right side lip/flange intersection angles range between about 45 degrees and 135 degrees.

3. The bullnose corner member of claim 1 wherein the left and right side lip/flange intersection angles are ninety degrees.

4. The bullnose corner member of claim 1 wherein the left and right side lip surfaces are generally planar in shape.

5. The bullnose corner member of claim 1 wherein the left and right side lip surfaces are generally concave in shape to better hold or retain said stucco finish.

6. The bullnose corner member of claim 1 wherein the left and right side lip surfaces are generally V-shaped troughs to better hold or retain said stucco finish.

7. The bullnose corner member of claim 1 wherein the left and right side lip surfaces contain structural features to retain or adhere stucco from the group consisting of divots, dimples, roughening, etching lines, striations, and corrugations.

8. The bullnose corner member of claim 1 wherein the adjustable bullnose flange angle ranges between about 45 degrees and 135 degrees.

9. The bullnose corner member of claim 1 wherein the adjustable bullnose flange angle is 90 degrees.

10. The bullnose corner member of claim 1 wherein the left side flange or the right side flange contain one or more flange perforations.

11. The bullnose corner member of claim 1 wherein the left side lip or the right side lip contain one or more lip perforations.

12. The bullnose corner member of claim 1 wherein the bullnose arcuate edge contains one or more bullnose edge perforations to serve to permit some of the stucco finish to ooze through said perforations onto the bullnose inner surface to assist in locking down the stucco material to the bullnose outer surface.

13. The bullnose corner member of claim 1 wherein the bullnose corner members are constructed out of materials selected from the group consisting of: solid metal material, alloys such as titanium, zinc and aluminum alloys, HST aluminum, 431 stainless steel, 17-4 stainless steel, Ti-alloy, galvanized steel, maraging metal, bi-metal, tungsten insert, and compositions thereof, and flat stock metal materials that may be stamped, crimped or roll formed into the desired bullnose corner member configuration.

14. The bullnose corner member of claim 1 wherein the outer surfaces of the left side flange, right side flange, right side lip, left side lip, or the bullnose arcuate edge contain structural features to enhance the adhesion/adherence of the stucco to such outer surfaces, including surface dimples, scratches, etches, striations, perforations, or corrugations.

15. An adjustable, metal radius bullnose corner member having an architecturally radiused curvature along the length of its outer surface for mounting over and strengthening the structural integrity of first and second adjacent, abutting exterior corner wall members of a structure and for receiving on its outer surface a wall plastering material such as stucco or the like used to finish the corner to match the finish of the two adjacent wall members, the abutting wall members each comprising an outer face, an inner face, opposed top and bottom edges and opposed side edges, said edges forming a wall member thickness between said outer and inner wall member faces, wherein one of said opposed side edges of said first wall member abuts up against the inner face of said second wall member adjacent one of said opposed side edges of said second wall member, said adjacent side edge of said second wall member being aligned to be flush with said outer face of said adjacent first wall member to form a corner edge, the bullnose corner member comprising:

a. a radiused bullnose arcuate outer surface capable of receiving said plastering material running the length of the bullnose corner member, the bullnose arcuate outer surface having two opposed parallel right and left side edges, a central curved section flanked by two linear left and right planar sections extending to the left and right side bullnose arcuate outer surface edges, respectively, the central curved section having left and right endpoints, the distance between such endpoints defining a chord having a chord length, the central curved section being flexible to permit adjusting the chord length during installation of the bullnose corner member over the two adjacent corners, b. a substantially rectangular right side shoulder stop capable of receiving said plastering material having two opposed parallel top and bottom right side shoulder stop edges, the top right side shoulder edge attached to and extending downwardly from the bullnose arcuate outer surface right side edge at a bullnose top right side shoulder stop/bullnose right edge inside intersection angle ranging between about 135 degrees and about 45 degrees, c. a substantially rectangular left side shoulder stop capable of receiving said plastering material having two opposed parallel top and bottom left side shoulder stop edges, the top left side shoulder edge attached to and extending downwardly from the bullnose arcuate outer surface left side edge at a bullnose top left side shoulder stop/bullnose left edge inside intersection angle ranging between about 135 degrees and about 45 degrees, d. a substantially rectangular right side attachment flange, capable of being mounted to one of said two adjacent wall members and capable of receiving said plastering material after having been mounted, the flange having two opposed parallel inside and outside right side flange edges, the inside right side flange edge attached to and extending outwardly from the bottom right side shoulder stop edge at a right side shoulder/flange intersection angle ranging between about 45 degrees and about 135 degrees, e. a substantially rectangular left side attachment flange capable of being mounted to the other of said two adjacent wall members and capable of receiving said plastering material after having been mounted, the flange having two opposed parallel inside and outside left side flange edges, the inside left side flange edge attached to and extending outwardly from the bottom left side shoulder stop edge at a left side shoulder/flange intersection angle ranging between about 45 degrees and about 135 degrees, f. a radiused bullnose arcuate inner surface running the length of the bullnose corner member beneath said arcuate outer surface, the bullnose top right side shoulder stop/bullnose right edge inside intersection angle and the right side shoulder/flange intersection angle adding up to be about 180 degrees, the bullnose top left side shoulder stop/bullnose left edge inside intersection angle and the left side shoulder/flange intersection angle adding up to be about 180 degrees, the bullnose outer surface left and right planar sections being substantially parallel to the respective left and right flanges when the bullnose corner member is mounted over the two adjacent wall members, said right side shoulder stop and said left side shoulder stop having widths sufficiently wide enough to permit the bullnose corner member to be placed over said adjacent, abutting wall members such that there remains sufficient space for the corner edge of the abutting wall member to reside proximate said bullnose arcuate inner surface when the bullnose corner member is mounted over the two adjacent wall members.

16. The adjustable radius bullnose corner member of claim 15 wherein the bullnose top right side shoulder stop/bullnose right edge inside intersection angle is about 90 degrees, the bullnose top left side shoulder stop/bullnose left edge inside intersection angle is about 90 degrees, the right side shoulder/flange intersection angle is about 90 degrees, and the left side shoulder/flange intersection angle is about 90 degrees.

17. A flexible, metal elongate bullnose corner member for attaching to and covering an external, continuous corner intersection of two adjacent, abutting exterior wall members of a structure that will receive a stucco finish of a desired thickness, the abutting wall members each comprising an outer face, an inner face, opposed top and bottom edges and opposed side edges, said edges forming a wall member thickness between said outer and inner wall member faces, wherein one of said opposed side edges of said first wall member abuts up against the inner face of said second wall member adjacent one of said opposed side edges of said second wall member, said adjacent side edge of said second wall member being aligned to be flush with said outer face of said adjacent first wall member to form a corner edge, the bullnose corner member comprising:

a. a top side, b. a bottom side, c. a right side flange having a right side flange outer edge and a right side flange inner edge opposite the right side flange outer edge, a right side flange upper edge extending between the right side flange outer edge and the right side flange inner edge, the right side flange upper edge intersecting with the right side flange outer edge at a right side flange upper edge outside end, the right side flange upper edge also intersecting with the right side flange inner edge at a right side flange upper edge inside end, a right side flange lower edge extending between the right side flange outer edge and the right side flange inner edge, and being opposite the right side flange upper edge, the right side flange lower edge intersecting with the right side flange outer edge at a right side flange lower edge outside end, the right side flange lower edge also intersecting with the right side flange inner edge at a right side flange lower edge inside end, a width defined as the distance between the right side flange inner edge and the right side flange outer edge, a right side flange outer surface forming part of the bullnose corner member top side and a right side flange inner surface forming a part of the bullnose corner member bottom side, said right side flange inner surface being attachable with suitable fasteners to one of said two exterior wall members, said right side flange outer surface being capable of receiving said stucco finish after being fastened to said wall member, d. a left side flange having a left side flange outer edge and a left side flange inner edge opposite the left side flange outer edge, a left side flange upper edge extending between the left side flange outer edge and the left side flange inner edge, the left side flange upper edge intersecting with the left side flange outer edge at a left side flange upper edge outside end, the left side flange upper edge also intersecting with the left side flange inner edge at a left side flange upper edge inside end, a left side flange lower edge extending between the left side flange outer edge and the left side flange inner edge, and being opposite the left side flange upper edge, the left side flange lower edge intersecting with the left side flange outer edge at a left side flange lower edge outside end, the left side flange lower edge also intersecting with the left side flange inner edge at a left side flange lower edge inside end, a width defined as the distance between the left side flange inner edge and the left side flange outer edge, a left side flange outer surface forming a part of the bullnose corner member top side and a left side flange inner surface forming a part of the bullnose corner member bottom side, said left side flange inner surface being attachable with suitable fasteners to the other of said two exterior wall members, said left side flange outer surface being capable of receiving said stucco finish after being fastened to said wall member, wherein the right and left flange inner edges are joined together to form a unitary flange/lip intersection seam, e. a generally rectangular bullnose arcuate edge section having a bullnose right edge and a bullnose left edge opposite thereto, a bullnose upper curved end extending between the bullnose right edge and the bullnose left edge, the bullnose upper curved end intersecting with the bullnose right edge at a bullnose upper end right side corner, the bullnose upper curved end intersecting with the bullnose left edge at a bullnose upper end left side corner, a bullnose lower curved end opposite the upper curved end extending between the bullnose right edge and the bullnose left edge, the bullnose lower curved end intersecting with the bullnose right edge at a bullnose lower end right side corner, the bullnose lower curved end intersecting with the bullnose left edge at a bullnose lower end left side corner, a convex-shaped bullnose outer surface capable of receiving said stucco finish, and a bullnose inner surface, f. a generally rectangular bullnose right side lip extending between the right side flange inner edge and the bullnose right edge, the bullnose right side lip left edge sharing the same edge as the bullnose right edge, the bullnose right side lip right edge sharing the same edge as the right side flange inner edge, a bullnose right side lip top edge extending between the right side flange upper edge inside end and the bullnose upper end right side corner, a bullnose right side lip bottom edge extending between the right side flange lower edge inside end and the bullnose lower end right side corner, a bullnose right side lip top surface capable of receiving said stucco finish and a bullnose right side underside surface, a width defined as the distance between the right side flange inner edge and the bullnose right edge, the bullnose right side lip meeting the right side flange at a desired right side lip/flange intersection angle, g. a generally rectangular bullnose left side lip extending between the left side flange inner edge and the bullnose left edge, the bullnose left side lip right edge sharing the same edge as the bullnose left edge, the bullnose left side lip left edge sharing the same edge as the left side flange inner edge, a bullnose left side lip top edge extending between the left side flange upper edge inside end and the bullnose upper end left side corner, a bullnose left side lip bottom edge extending between the left side flange lower edge inside end and the bullnose lower end left side corner, a bullnose left side lip top surface capable of receiving said stucco finish and a bullnose left side underside surface, a width defined as the distance between the left side flange inner edge and the bullnose left edge, the bullnose left side lip meeting the left side flange at a desired left side lip/flange intersection angle, and h. an adjustable bullnose flange angle defined as the angle between the right side flange inner surface and the left side flange inner surface.

18. The bullnose corner member of claim 17 wherein the right and left flange inner edges are joined together by welding, gluing, spot welding or via extrusion.

* * * * *